US008469831B2

(12) United States Patent
Jobe

(10) Patent No.: US 8,469,831 B2
(45) Date of Patent: Jun. 25, 2013

(54) CYCLOID RAMP FOR GRAVITY RACE CARS

(76) Inventor: John Dewey Jobe, Missouri City, TX (US)

( * ) Notice: Subject to any disclaimer, the term of this patent is extended or adjusted under 35 U.S.C. 154(b) by 365 days.

(21) Appl. No.: 12/806,157

(22) Filed: Aug. 6, 2010

(65) Prior Publication Data

US 2012/0034984 A1 Feb. 9, 2012

(51) Int. Cl.
*A63K 1/00* (2006.01)
*A63H 18/00* (2006.01)

(52) U.S. Cl.
USPC ..... 472/85; 472/88; 446/444

(58) Field of Classification Search
USPC ..... 472/85–90; 446/429, 444–449; 104/53, 104/60, 68; 463/58–60
See application file for complete search history.

(56) References Cited

U.S. PATENT DOCUMENTS 3,502,332 A * 3/1970 Wolf ..... 463/69
5,253,864 A * 10/1993 Heege et al. ..... 472/88
7,241,223 B1 * 7/2007 Caudill ..... 463/62
7,651,398 B2 * 1/2010 Ostendorff et al. ..... 463/60
8,016,639 B2 * 9/2011 Jobe ..... 446/429

OTHER PUBLICATIONS

Cub Scout Leader "How-To-Book" by the Boy Scouts of America, Irving, TX, 1987 p. 9-40 (see attached showing drawing of ramp).
Micro Wizard, owned by Stuart Ferguson, 10007 Old Union Rd, Union, KY 41091 (see attached from www/pinewoodderbytrack.com), Jul. 6, 2010.
The BestTrack, owned by SRM Enterprises Inc, P.O Box 53, Forest City, IA 50436 (see attached from www.besttrack.com), Jul. 6, 2010.
The Derby Magic Company owned by Robert Hasse, 2785 Walnu Lake Rd. Bloomington, MI, 48323 (see attached from www.derbymagic.com), Jul. 6, 2010.

* cited by examiner

*Primary Examiner* — Kien Nguyen

(57) ABSTRACT

This invention relates to gravity-driven car racing, specifically an improved ramp, such as used in the popular Pinewood Derby race, which is cycloid shaped. The present invention eliminates excessive centripetal force and related problems such as car oscillation caused by prior art ramps which are curved too much or curved in the wrong places. The present invention comprises a ramp shaped as a section of a cycloid curve with the ramp bottom tangent to the horizontal coasting run. It can be shown mathematically that such a curve will produce the least possible centripetal force and associated friction increase in the car wheels as it accelerates toward the coasting run. The present invention causes a ramp to assume the cycloid shape by applying appropriate bending forces to the underside of the ramp. In a preferred embodiment, a hinged brace automatically applies the key bending force as the main support legs are lowered.

34 Claims, 8 Drawing Sheets

| Row No | Ref No | *h* (fract) | *y* (cm) | *Y* (cm) | θ (rad) | *x* (cm) | *X* (cm) | *d* (fract) | *s* (cm) | *S* (ft) |
|---|---|---|---|---|---|---|---|---|---|---|
| 1 | 31 | 1.00 | 357.42 | 119.38 | 2.094 | 292.53 | 0.00 | 0.000 | 0.00 | 0.33 |
| 2 | | 0.96 | 362.20 | 114.60 | 2.117 | 300.91 | 8.37 | 0.018 | 9.64 | 0.65 |
| 3 | | 0.92 | 366.97 | 109.83 | 2.140 | 309.51 | 16.98 | 0.037 | 19.48 | 0.97 |
| 4 | | 0.88 | 371.75 | 105.05 | 2.164 | 318.37 | 25.83 | 0.057 | 29.54 | 1.30 |
| 5 | | 0.84 | 376.52 | 100.28 | 2.189 | 327.49 | 34.95 | 0.077 | 39.84 | 1.64 |
| 6 | 32 | 0.80 | 381.30 | 95.50 | 2.214 | 336.88 | 44.34 | 0.097 | 50.38 | 1.99 |
| 7 | | 0.76 | 386.07 | 90.73 | 2.239 | 346.57 | 54.04 | 0.118 | 61.18 | 2.34 |
| 8 | | 0.72 | 390.85 | 85.95 | 2.265 | 356.59 | 64.05 | 0.140 | 72.28 | 2.70 |
| 9 | | 0.68 | 395.62 | 81.18 | 2.291 | 366.95 | 74.41 | 0.163 | 83.68 | 3.08 |
| 10 | | 0.64 | 400.40 | 76.40 | 2.318 | 377.68 | 85.15 | 0.187 | 95.43 | 3.46 |
| 11 | 33 | 0.60 | 405.17 | 71.63 | 2.346 | 388.82 | 96.29 | 0.211 | 107.55 | 3.86 |
| 12 | | 0.56 | 409.95 | 66.85 | 2.374 | 400.41 | 107.88 | 0.236 | 120.09 | 4.27 |
| 13 | | 0.52 | 414.72 | 62.08 | 2.403 | 412.49 | 119.95 | 0.263 | 133.07 | 4.70 |
| 14 | | 0.48 | 419.50 | 57.30 | 2.434 | 425.12 | 132.58 | 0.290 | 146.57 | 5.14 |
| 15 | 34 | 0.44 | 424.27 | 52.53 | 2.465 | 438.36 | 145.82 | 0.319 | 160.65 | 5.60 |
| 16 | | 0.40 | 429.05 | 47.75 | 2.498 | 452.29 | 159.75 | 0.350 | 175.38 | 6.09 |
| 17 | | 0.36 | 433.82 | 42.98 | 2.532 | 467.02 | 174.49 | 0.382 | 190.86 | 6.60 |
| 18 | 35 | 0.32 | 438.60 | 38.20 | 2.568 | 482.68 | 190.15 | 0.417 | 207.24 | 7.13 |
| 19 | | 0.28 | 443.37 | 33.43 | 2.606 | 499.45 | 206.91 | 0.453 | 224.67 | 7.70 |
| 20 | | 0.24 | 448.15 | 28.65 | 2.646 | 517.56 | 225.02 | 0.493 | 243.40 | 8.32 |
| 21 | | 0.20 | 452.92 | 23.88 | 2.690 | 537.36 | 244.82 | 0.536 | 263.77 | 8.99 |
| 22 | | 0.16 | 457.70 | 19.10 | 2.739 | 559.37 | 266.84 | 0.585 | 286.30 | 9.73 |
| 23 | | 0.12 | 462.47 | 14.33 | 2.793 | 584.49 | 291.96 | 0.640 | 311.87 | 10.57 |
| 24 | 36 | 0.08 | 467.25 | 9.55 | 2.858 | 614.45 | 321.91 | 0.705 | 342.20 | 11.56 |
| 25 | | 0.04 | 472.02 | 4.78 | 2.941 | 653.68 | 361.15 | 0.791 | 381.73 | 12.86 |
| 26 | 37 | 0.00 | 476.80 | 0.00 | 3.142 | 748.96 | 456.42 | 1.000 | 477.16 | 16.00 |

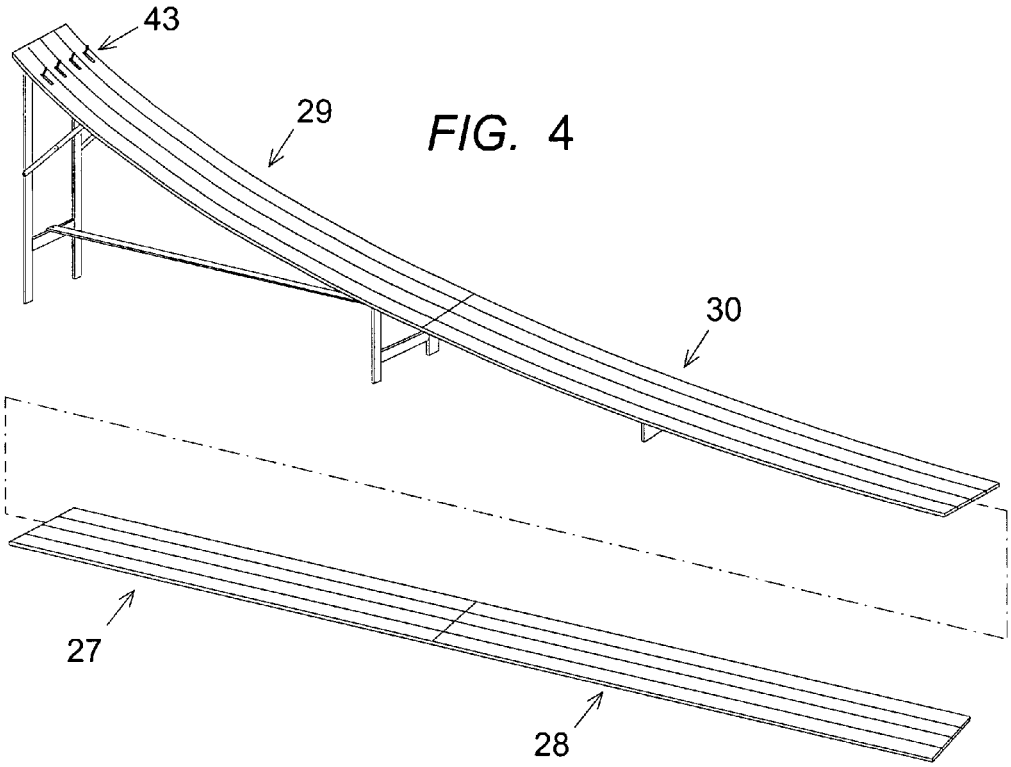
FIG. 4
FIG. 5
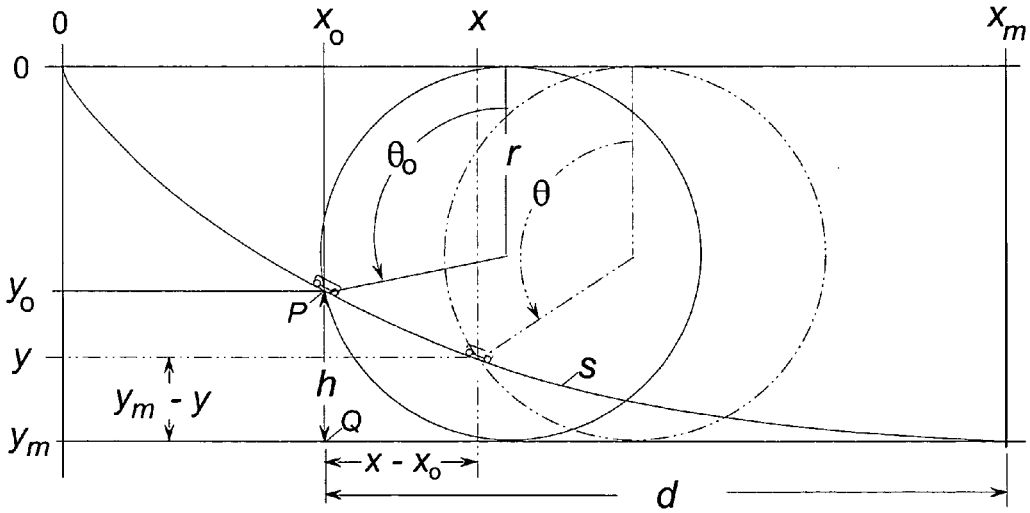

FIG. 6

| Row No | Ref No | *h* (fract) | *y* (cm) | *Y* (cm) | θ (rad) | *x* (cm) | *X* (cm) | *d* (fract) | *s* (cm) | *S* (ft) |
|---|---|---|---|---|---|---|---|---|---|---|
| 1 | 31 | 1.00 | 357.42 | 119.38 | 2.094 | 292.53 | 0.00 | 0.000 | 0.00 | 0.33 |
| 2 | | 0.96 | 362.20 | 114.60 | 2.117 | 300.91 | 8.37 | 0.018 | 9.64 | 0.65 |
| 3 | | 0.92 | 366.97 | 109.83 | 2.140 | 309.51 | 16.98 | 0.037 | 19.48 | 0.97 |
| 4 | | 0.88 | 371.75 | 105.05 | 2.164 | 318.37 | 25.83 | 0.057 | 29.54 | 1.30 |
| 5 | | 0.84 | 376.52 | 100.28 | 2.189 | 327.49 | 34.95 | 0.077 | 39.84 | 1.64 |
| 6 | 32 | 0.80 | 381.30 | 95.50 | 2.214 | 336.88 | 44.34 | 0.097 | 50.38 | 1.99 |
| 7 | | 0.76 | 386.07 | 90.73 | 2.239 | 346.57 | 54.04 | 0.118 | 61.18 | 2.34 |
| 8 | | 0.72 | 390.85 | 85.95 | 2.265 | 356.59 | 64.05 | 0.140 | 72.28 | 2.70 |
| 9 | | 0.68 | 395.62 | 81.18 | 2.291 | 366.95 | 74.41 | 0.163 | 83.68 | 3.08 |
| 10 | | 0.64 | 400.40 | 76.40 | 2.318 | 377.68 | 85.15 | 0.187 | 95.43 | 3.46 |
| 11 | 33 | 0.60 | 405.17 | 71.63 | 2.346 | 388.82 | 96.29 | 0.211 | 107.55 | 3.86 |
| 12 | | 0.56 | 409.95 | 66.85 | 2.374 | 400.41 | 107.88 | 0.236 | 120.09 | 4.27 |
| 13 | | 0.52 | 414.72 | 62.08 | 2.403 | 412.49 | 119.95 | 0.263 | 133.07 | 4.70 |
| 14 | | 0.48 | 419.50 | 57.30 | 2.434 | 425.12 | 132.58 | 0.290 | 146.57 | 5.14 |
| 15 | 34 | 0.44 | 424.27 | 52.53 | 2.465 | 438.36 | 145.82 | 0.319 | 160.65 | 5.60 |
| 16 | | 0.40 | 429.05 | 47.75 | 2.498 | 452.29 | 159.75 | 0.350 | 175.38 | 6.09 |
| 17 | | 0.36 | 433.82 | 42.98 | 2.532 | 467.02 | 174.49 | 0.382 | 190.86 | 6.60 |
| 18 | 35 | 0.32 | 438.60 | 38.20 | 2.568 | 482.68 | 190.15 | 0.417 | 207.24 | 7.13 |
| 19 | | 0.28 | 443.37 | 33.43 | 2.606 | 499.45 | 206.91 | 0.453 | 224.67 | 7.70 |
| 20 | | 0.24 | 448.15 | 28.65 | 2.646 | 517.56 | 225.02 | 0.493 | 243.40 | 8.32 |
| 21 | | 0.20 | 452.92 | 23.88 | 2.690 | 537.36 | 244.82 | 0.536 | 263.77 | 8.99 |
| 22 | | 0.16 | 457.70 | 19.10 | 2.739 | 559.37 | 266.84 | 0.585 | 286.30 | 9.73 |
| 23 | | 0.12 | 462.47 | 14.33 | 2.793 | 584.49 | 291.96 | 0.640 | 311.87 | 10.57 |
| 24 | 36 | 0.08 | 467.25 | 9.55 | 2.858 | 614.45 | 321.91 | 0.705 | 342.20 | 11.56 |
| 25 | | 0.04 | 472.02 | 4.78 | 2.941 | 653.68 | 361.15 | 0.791 | 381.73 | 12.86 |
| 26 | 37 | 0.00 | 476.80 | 0.00 | 3.142 | 748.96 | 456.42 | 1.000 | 477.16 | 16.00 |

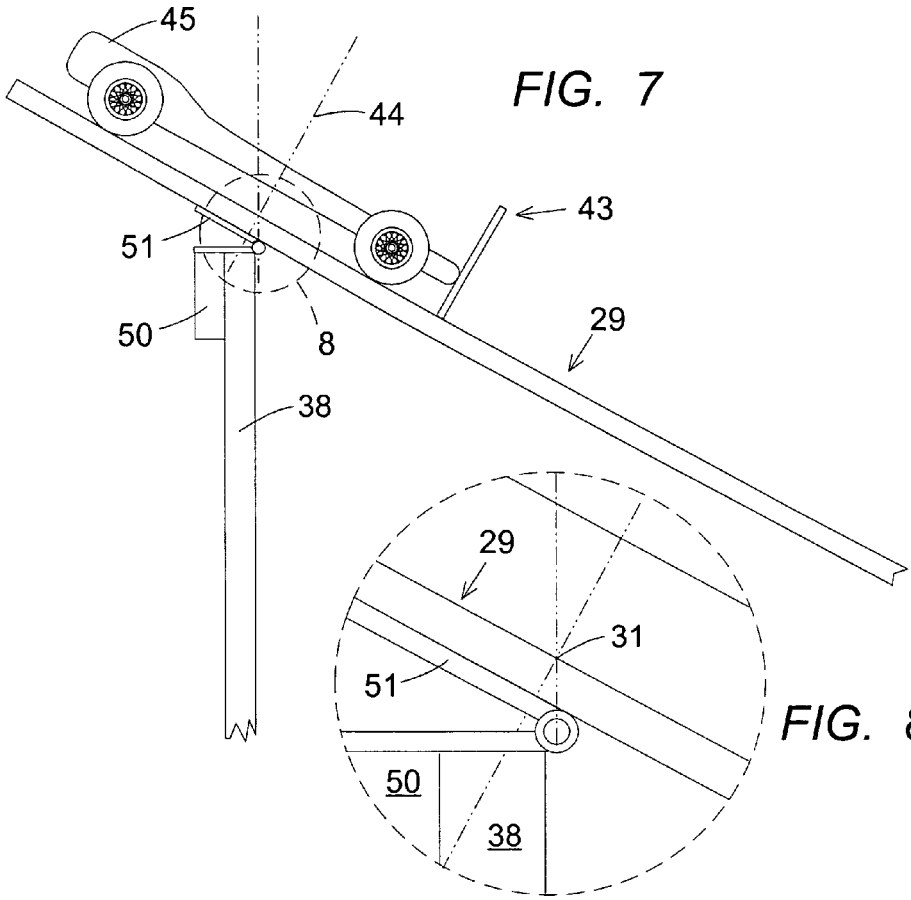
FIG. 7
FIG. 8
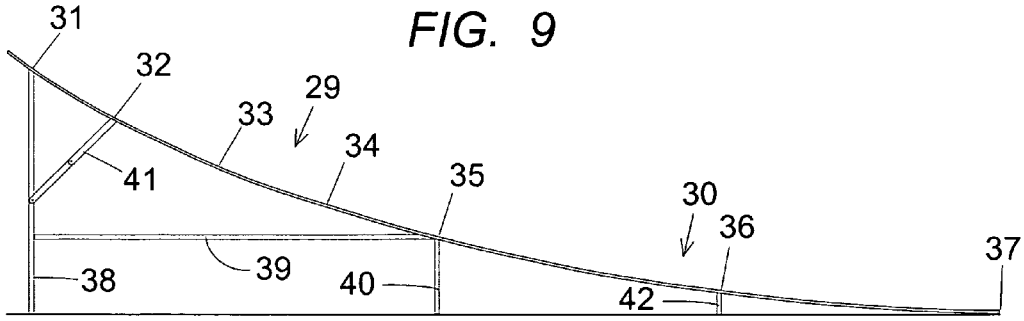
FIG. 9

CYCLOID RAMP FOR GRAVITY RACE CARS

CROSS REFERENCE TO RELATED APPLICATIONS

This application claims the benefit of patent application Ser. Nos. 12/321,320 filed Jan. 16, 2009 and 12/455,796 filed Jun. 5, 2009, both by the present inventor, which are incorporated herein by reference.

FEDERALLY SPONSORED RESEARCH

Not Applicable

SEQUENCE LISTING OR PROGRAM

Not Applicable

BACKGROUND

1. Field of Invention

This invention relates to gravity-driven car racing, specifically an improved cycloid-shaped ramp for race tracks such as used in the popular Pinewood Derby race.

2. Prior Art

Millions of Pinewood Derby races have been run since the inception of the race in 1953, mostly by Cub Scouts and their parents. But the currently available race tracks have a problem in the way the ramps are shaped. Refer to the prior art FIGS. 1 and 2 which point out side views typical of ramps currently in use. In one commonly used ramp in FIG. 1, the ramp material used to form either one lane or several of side-by-side lanes has unsupported regions, allowing the ramp to sag slightly under its own weight with an unspecified curvature. In this type ramp, the free sag also allows the curvature to vary depending on a car's weight, thus the car which is the leader can slightly increase the descent angle of its nearby competitors. In another commonly used ramp, as in FIG. 2, the ramp shape is predominately that of a straight plane inclined at a fixed angle. In such a ramp, as the horizontal is approached, a rather sharp curve in the ramp is used to allow the cars to transition into the horizontal coasting section of the track which can be up to 32 ft. (9.8 meters) long. However, the rather sharp transition curve can also cause excessive car weight from centripetal force.

To explain prior art in more detail, we refer now to the published information on 4 ramps as shown in the Information Disclosure section of this application. These ramps are:

1) Cub Scout Leader "How-To-Book", Irving, Tex., 1987, p 9-40
2) Micro Wizard, of pinewoodderbytrack.com
3) The BestTrack™ of www.besttrack.com
4) The Derby Magic track of www.derbymagic.com Referring again to FIG. 1, which shows a ramp 19, with a pinewood derby car 20 at the top, with the ramp end transitioning to a horizontal coasting run in the area of 21. All 4 ramps listed above have a main stand 22, which supports the ramp highest point, and also a secondary support stand 23. A brace 24, or 25 in FIG. 2, which keeps the main stand in a vertical position, is common in all ramps. The original wooden ramp design as in 1) above has a profile very similar to FIG. 1, where the recommended ½ inch thick plywood ramp has only a modest sag. The Micro Wizard ramp 2) is extruded aluminum and also has a support structure similar to FIG. 1. This ramp also has a sag similar to FIG. 1. The type of curvature shown by 1) and 2) is more at the bottom of the ramp than at the ramp top. Thus, when a race car pulls out of its descent at high speeds towards the bottom of these ramps, the centripetal force can be larger than necessary and cause the car weight to increase over 30%.

Referring now to FIG. 2, we see a straight inclined plane ramp profile with a sharp curve where the incline transitions to the level horizontal coasting section of the track. An example is the BestTrack ramp 3), of ordinary aluminum construction, with a brace 25 whose only purpose is to keep the main stand vertical. The transition to horizontal, shown in FIG. 3, of the BestTrack ramp, is a stiff pre-formed aluminum section 26 with a radius of curvature of 4 feet (1.22 meters). The Derby Magic ramp 4) also has a profile similar to FIGS. 2 and 3. This ramp is made from plastic, and prevents ramp sag before the transition curve by using a flat support structure of aluminum members for most of the downward ramp travel. But the centripetal force on the rather sharp transition section curves of ramp 3) or ramp 4) can cause the race car weight to be 3 times higher than on the straight sections of the ramp and coasting run. Thus an ordinary 5 ounce (0.142 Kg) race car will momentarily weigh almost 1 pound (0.45 Kg) and the centripetal force alone will be 8 times more than necessary. It has been observed that cars with uneven wheel-axle lubrication can begin oscillations back and forth when such a sudden weight increase occurs, such oscillations causing a substantial loss in the car speed. Also, cars with thin "speed" axles can suffer axle bending under the weight increase caused by excessive centripetal force.

SUMMARY

The present invention eliminates the excessive centripetal force and related problems caused by prior art ramps which have excessively curved ramps, especially at the ramp bottom where the car velocity is highest. The present invention comprises a ramp shaped as a section of a cycloid curve with the bottom tangent to the horizontal. It can be shown mathematically that such a curve will produce the least possible centripetal force on the race car as the car accelerates toward the coasting run. The present invention causes a ramp to assume the cycloid shape by applying appropriate bending forces to the underside of the ramp. In a preferred embodiment, a hinged brace automatically applies the key bending force as the main support legs are lowered.

DRAWINGS

Figures

FIG. 1 refers to prior art associated with a natural sag ramp.

FIG. 2 refers to prior art associated with an inclined plane ramp.

FIG. 4 shows a perspective view of the preferred embodiment.

FIG. 5 shows a diagram of cycloid curve generation.

FIG. 6 shows a table related to cycloid curve generation.

FIG. 7 shows detail of a car's starting position.

FIG. 8 shows a magnified view of the starting position.

FIG. 9 shows a side view of the cycloid ramp.

Figure 1:
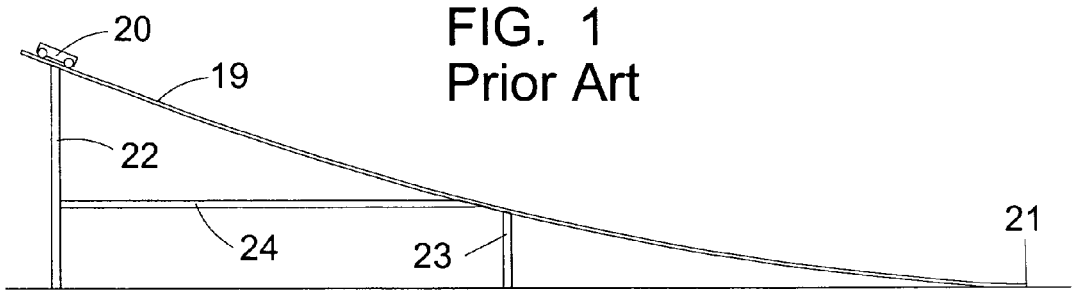
FIG. 1 Prior Art
Figure 2:
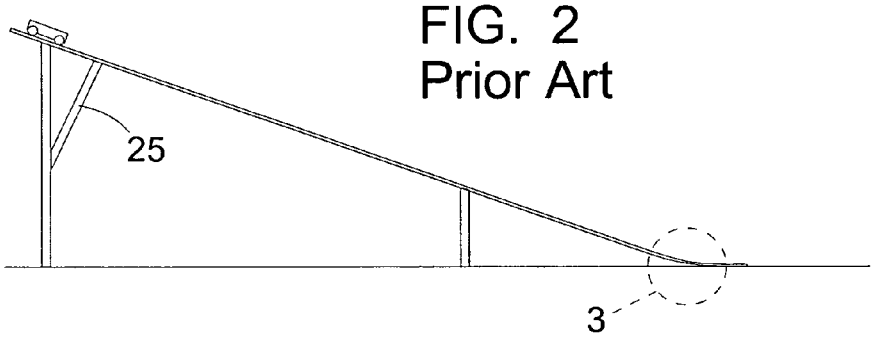
FIG. 2 Prior Art
Figure 3:
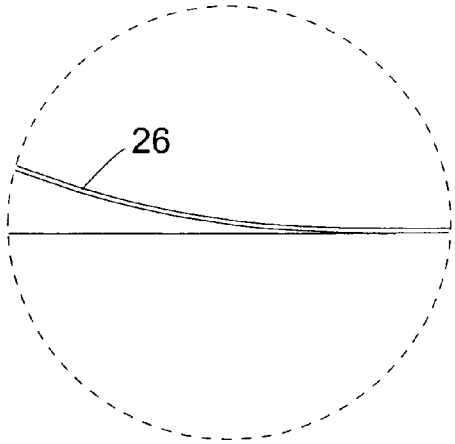
FIG. 3 Prior Art
FIG. 3 shows a magnified view of FIG. 2 in the transition section

| DRAWINGS - Reference Numerals | |
|---|---|
| 19 | prior art ramp with natural sag |
| 20 | prior art gravity-driven race car |
| 21 | prior art area where a ramp ends |
| 22 | prior art main support leg pair |
| 23 | prior art secondary support leg pair |
| 24 | prior art horizontal brace |
| 25 | prior art main support leg brace pair |
| 26 | prior art transition curve |
| 27 | first coasting run section |
| 28 | second coasting run section |
| 29 | first ramp section |
| 30 | second ramp section |
| 31 | $1^{st}$ cycloid height point |
| 32 | $2^{nd}$ cycloid height point |
| 33 | $3^{rd}$ cycloid height point |
| 34 | $4^{th}$ cycloid height point |
| 35 | $5^{th}$ cycloid height point |
| 36 | $6^{th}$ cycloid height point |
| 37 | $7^{th}$ cycloid height point |
| 38 | main support leg pair |
| 39 | main support leg pair horizontal brace |
| 40 | secondary support leg pair |
| 41 | pair of hinged tension braces |
| 42 | support member for $6^{th}$ cycloid height |
| 43 | starting posts |
| 44 | car body midpoint |
| 45 | gravity-driven car |
| 46 | hinge support block |
| 47 | hinge |
| 48 | bottom brace for main support leg pair |
| 49 | cross piece to apply downward force |
| 50 | top brace for main support leg pair |
| 51 | hinge for main support leg pair |
| 52 | anchor bolt |
| 53 | turnbuckle for applying force |
| 54 | Flat main support sheet |
| 55 | Flat secondary support sheet |
| 56 | Cutout hole in main sheet |
| 57 | Bracket for ramp underside |
| 58 | support leg for $2^{nd}$ cycloid height |
| 59 | support leg for $3^{rd}$ cycloid height |
| 60 | support leg for $4^{th}$ cycloid height |
| 61 | support leg for $5^{th}$ cycloid height |
| 62 | support leg for $6^{th}$ cycloid height |
| 63 | base board for attaching support legs |
| 64 | hinge for attaching support legs |
| 65 | brace for main support legs |
| 66 | hinge for main support member |
| 67 | first section support panel left |

-continued

| DRAWINGS - Reference Numerals | |
|---|---|
| 68 | first section support panel right |
| 69 | second section support panel left |
| 70 | second section support panel right |
| 71 | top cross piece support panel |
| 72 | center cross piece support panel |
| 73 | end cross piece support brace |

DETAILED DESCRIPTION OF A PREFERRED EMBODIMENT

FIGS. 4-7

General Ramp Description—FIG. 4

FIG. 4 shows a perspective view of one embodiment of a cycloid-shaped ramp. The ramp shown has 4 lanes, but may use anywhere from one to an arbitrary number of lanes. The ramp is 4.877 meters (16 ft.) in length. The cycloid-shaped ramp follows prior art length comprising a first section lane assembly 29 and a rigidly and smoothly joined ramp second section 30. For shipping and storage reasons, the length of these two sections are equal at about 2.443 meters (8 ft.). The coasting run sections 27 and 28, also of equal length, have a surface, which, when joined to the ramp 30, determine a flat horizontal plane, close to or just above a level supporting floor. A starting post assembly, 43, here comprising 4 posts, restrains the cars prior to a race.

Mathematical Ramp Description—FIGS. 5, 6, 7 and 8

FIG. 5 defines the variables to be used in describing the cycloid ramp. The cycloid derivation is covered in most advanced physics texts. This mathematical summary will teach the extraction of a cycloid section suitable for a ramp. The original problem was to find the curve of fastest descent for an object in a gravitational field, called the Brachistichrone problem. It was discovered to be a cycloid curve by Johann Bernoulli in 1697. What is even less apparent is that this cycloid curve also guarantees the least possible maximum centripetal reaction force by the curve on the descending object. The centripetal force is the mass times the centripetal acceleration, the latter being $v^2/\rho$. Here v is the object's velocity and $\rho$ is the radius of curvature of a cycloid-shaped ramp on which the object travels. So, if we increase curvature (smaller radius $\rho$) at the bottom part of a ramp where the velocity is high, we have $v^2/\rho$ large, i.e., a large centripetal reaction force. A cycloid curve on the other hand puts most, but limited, curvature at the ramp top, where velocity is small, and as the velocity increases towards the ramp bottom the curvature is gradually lessened, causing the centripetal force to remain small (larger $\rho$) and resulting in a smoother transition of the car onto the track's horizontal coasting run.

By comparison, if the ramp is mostly all straight inclined plane from the start, as in a flat zero curvature ramp (where $\rho$ is infinite), then there is no centripetal acceleration until the small $\rho$ is encountered on the sharp curved transition at the end of the ramp. In this case, all the centripetal reaction force is experienced at maximum velocity at the ramp end, and this force can be almost 8 times that of a cycloid-shaped ramp's maximum centripetal acceleration.

FIG. 5 shows that a cycloid curve may be generated by rolling a circle of radius r along the bottom of the x axis. A generating point, fixed on the circumference of the circle, will trace out a cycloid curve as the circle rolls without slipping. The circle rotates through angle $\theta$ as it rolls. If the fixed point starts at a Cartesian coordinate system (x, y) origin, the point where the cycloid curve starts at (0,0) is called the "cusp". The problem is to find the cycloid curve section with a height and length extent that is defined by two parameters which are distances as measured from the section coordinate origin, a fixed point on a fixed horizontal plane. In FIG. 5 the point marked Q is the section coordinate origin. One of the two parameters is the height parameter h, also called the starting height h, defined as the vertical distance from the cycloid section origin Q to a point P called the starting point on the cycloid curve, such point marking the start of the cycloid curve section. The other parameter is the section length parameter, called d, defined as the horizontal distance from the section coordinate origin at Q to a point on the cycloid curve called the end point where the curve becomes tangent to the horizontal plane at $x_m$. The curve section between the starting point and end point has a essentially an infinity of intermediate points between h and d, with each of these intermediate points specified by a pair of coordinates, consisting of a length coordinate X, a measure of horizontal distance from Q to directly below the intermediate point, and also consisting of a height coordinate Y, which is a measure of the vertical distance above the horizontal plane to the intermediate point. In FIG. 5, the $x-x_o$ distance is X, and the $y_m-y$ distance is Y.

The (X, Y) coordinates will be the ones used in constructing a ramp with a cycloid curvature. Note that the y axis is positive downwards. Below we will define all the various coordinates, or vertical and horizontal distances, that specify the points on the cycloid curve. We will then show how these distances can be derived from the cycloid parametric equations.

1. (x, y) are the coordinates of the cycloid curve as measured from the origin at (0,0). These coordinates are functions of the cycloid parameters which are the rolling circle radius r and the angle of rotation θ of the rolling circle. The parametric equations are (1) and (2) below:

$$x=r(\theta-\sin\theta) \tag{1}$$

$$y=r(1-\cos\theta) \tag{2}$$

2. $(x_o, y_o)$ are the coordinates that specify the start P of the cycloid curve section as found from the parametric equations with parameter r fixed and parameter θ with the value $\theta_0$.

$$x_0=r(\theta_0-\sin\theta_0) \tag{3}$$

$$y_0=r(1-\cos\theta_0) \tag{4}$$

3. (X, Y) are the coordinates of the points of the cycloid curve section:

$$X=x-x_0 \tag{5}$$

$$Y=y_m-y \tag{6}$$

In FIG. 5, the position of a car's center after it has moved down the track some arbitrary distance (x, y) is denoted by the phantom lines marking the new coordinates and also marking the new generating circle position. $x_m$ is the distance the circle has rolled until the fixed generating point on the circle touches the $y_m$ line, so this distance from (0,0) is half the circumference or $x_m=\pi r$. The $y_m$ distance from (0,0) is the circle diameter or $y_m=2r$. Thus we have:

$$d=x_m-x_o \text{ or } x_o=\pi r-d \tag{7}$$

$$h=y_m-y_o \text{ or } y_o=2r-h \tag{8}$$

We are now in a position to get the parametric equations (3) and (4) in terms of h and d by substituting for $(x_o,y_o)$ using equations (7) and (8), and then solving for r:

$$\pi r-d=r(\theta_0-\sin\theta_0) \tag{9}$$

$$2r-h=r(1-\cos\theta_0) \tag{10}$$

$$r=\frac{d}{\pi-\theta_0+\sin\theta_0} \tag{11}$$

$$r=\frac{h}{1+\cos\theta_0} \tag{12}$$

We next need to solve equations (11) and (12) for the circle radius r and the $\theta_0$ value for the given starting height h and section length d. It is customary in the art for the car starting height to be about 4 ft so we will make the ramp surface 1 inch lower at h=119.38 cm (47.00 in). It is also customary in the art for the ramp length d to be about 16 ft=487.68 cm and we thus estimate the projection on the horizontal will be somewhat less at d=456.42 cm. With h and d specified, the bottom pair of equations (11) and (12) above may be solved graphically for parameters r and $\theta_0$ by plotting each equation on graph paper with coordinates r and $\theta_0$, and noting that the curves cross at r=238.40 cm and $\theta_0$=119.95° (2.094 radians). These values will then give the section starting coordinates from (7) and (8)

$$x_0=\pi r-d=292.53 \text{ cm} \tag{13}$$

$$y_0=2r-h=357.42 \text{ cm} \tag{14}$$

The x and y coordinates must now be used in order to use the above to get (X, Y) values from equations (5) and (6). To get the x, y values for intermediate cycloid section points we need to solve for θ at a given y value from Eq. (2), and then substitute this θ value into Eq. (1) to get the corresponding x value. Eq. 2 gives $$\theta=\cos^{-1}\left(1-\frac{y}{r}\right) \tag{15}$$

$$x=r(\theta-\sin\theta) \tag{1}$$

As an example, for y=0.8 h we have θ=2.214 radians (rad) from Eq. (15) and x=336.88 cm from Eq. (1) giving X=44.34 cm and Y=95.50 cm from Eq (5) and (6) as the corresponding point on the cycloid curve section. Notice that one cannot easily reverse the above procedure because Eq. (1) is a transcendental equation that cannot be solved for θ. We are thus able to determine the coordinate pair (X, Y) by solving a pair of parametric equations of the cycloid curve in conjunction with the given parameters h and d.

One final equation gives the distance down the arc of the cycloid curve from the starting angle $\theta_0$ to any subsequent point defined by θ. This distance, called s, is:

$$s=4r\left[\cos\left(\frac{\theta_0}{2}\right)-\cos\left(\frac{\theta}{2}\right)\right] \tag{16}$$

FIG. 6 shows a table of the key variables, calculated as above, and used to specify the cycloid curve section. The table shows the starting and ending values plus values for 24 intermediate points. The objective of getting the (X, Y) points is to make the ramp surface coincide with these cycloid curvature section points by using several ramp support members. In FIG. 6 the 6 points 31 through 37 are key reference points in determining the cycloid shape for the ramp. The distances h (fract) and d (fract) give the decimal equivalent fraction of these parameters for the various (X, Y) points. For example, reference point 32 is 0.80 of the height h at 0.097 of the distance d. The joint joining first and second ramp sections occurs between rows 19 and 20 in FIG. 6. Also, the cycloid generating circle angle θ goes to 180° at the end of the ramp which is equivalent to $\pi$=3.142 radians. Because the physical ramp will have a definite thickness and its end surface at 37 must match the surface of the coasting run, then the reference horizontal plane for the FIG. 6 Y values would be at the height above floor of the coasting run surface. This height should be added to all Y values in FIG. 6 if they are measured from the floor.

FIGS. 7 and 8 are important to understanding just where the cycloid section starts. FIG. 7 shows detail of a gravity-driven car 45 in the starting position at the top of a first ramp section 29. The car nose rests against a starting post of the assembly 43 shown in FIG. 4. A line 44 perpendicular to the ramp and through the center of the car marks the starting point 31 on the ramp surface, directly over the pivot of a hinge 51 on a main support leg 38, where the cycloid curve section begins. Item 50 is a cross brace for the main leg pair shown later in detail. The enlarged view in FIG. 8 shows the point 31 more clearly. For a 7-inch (17.78 cm) long car this point would be 3.5 inch (8.89 cm) behind the starting posts. Most cars will have a 7 inch (17.78 cm) length, so the physical ramp itself extends behind the car center by 4 inches (10.16 cm). In FIG. 6, the symbol s denotes the arc distance, starting at point 31 to a point on the surface of a ramp that is coincident with the cycloid section. The symbol S denotes the distance from the top of the actual physical ramp 29, which starts 4 inches (0.33 ft) further back than the distance s start point denoted by line 44. The entire ramp arc distance S is 16.00 ft (487.68 cm).

Figure 10:
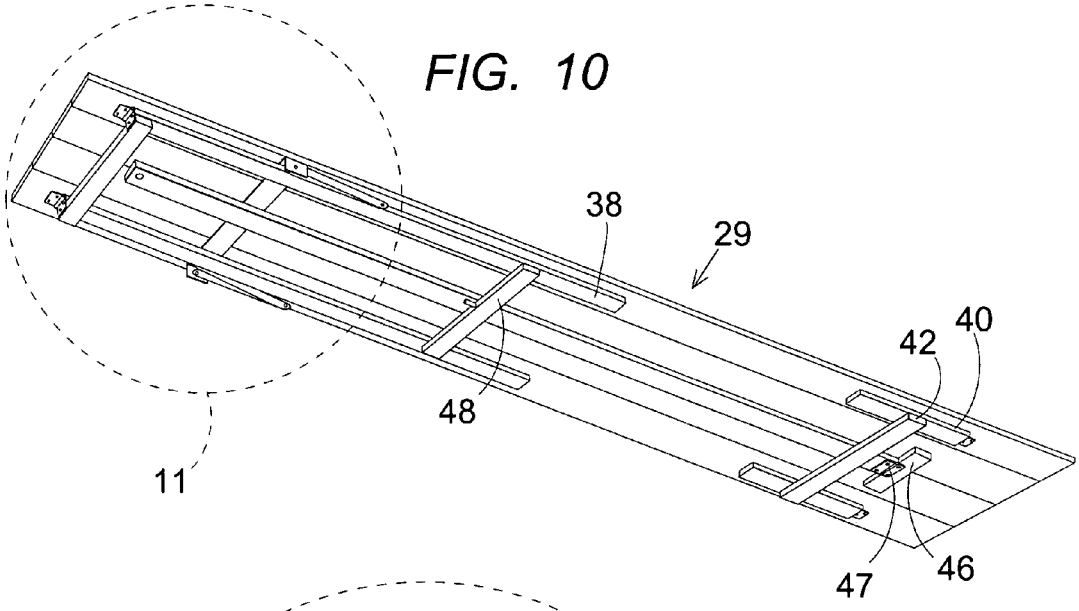
FIG. 10 shows a perspective view of the underside of the first cycloid ramp section.
Figure 11:
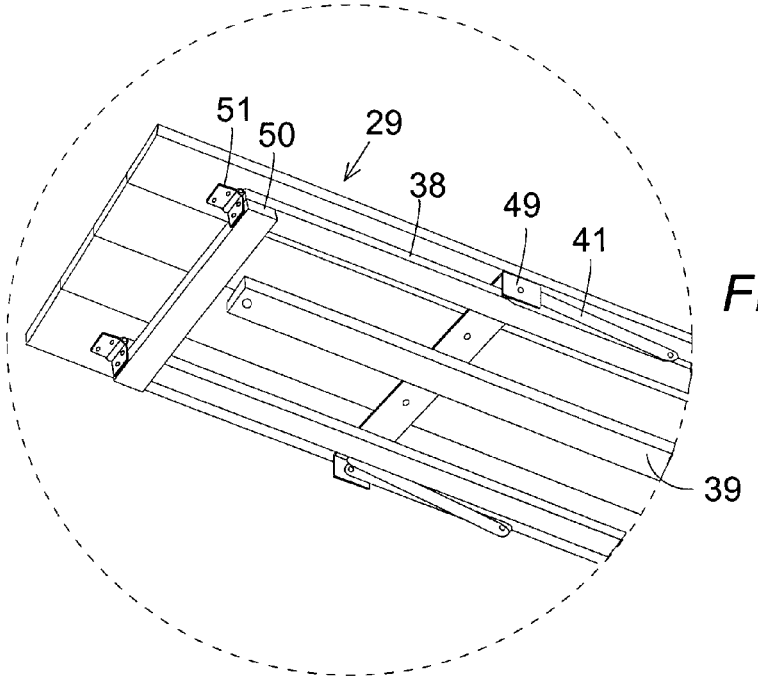
FIG. 11 shows a magnified view of the drop down main legs in FIG. 7.

Mechanical Description of Preferred Embodiment—FIGS. 9, 10 and 11

FIG. 9 shows a simplified side view of the preferred embodiment used to form a cycloid-shaped ramp. The support members, in this embodiment being leg pairs and braces, are arranged to force the ramp surface to substantially coincide with the starting height h and also to assume several of the intermediate points on the cycloid curve section having the coordinates (X, Y) as calculated in FIG. 6. FIG. 9 shows several (X, Y) reference points for the ramp surface to fit, starting at the point at height h which is the reference starting point 31, followed by a set of subsequent surface points 32, 33, 34, 35, 36, and 37. The leg pairs shown in side view in FIG. 9, shown later in detail in FIG. 10, are an example of ramp support by the floor, and are called floor support members. The braces not in direct contact with the floor are called brace support members. A brace 39 is a locking brace. Braces 41 are foldable tension braces. When deployed, the leg pairs, 38 and 40, and braces 41, can be of the proper length to force the point 31 on ramp section 29 to assume the starting height h and subsequent ramp surface points on section 29 to substantially coincide with all intermediate points on the cycloid curve section having coordinates (X, Y) as listed in FIG. 6. Floor support for ramp section 30 includes a short floor support member 42 which keeps point 36 at its (X, Y) value.

Reference to FIG. 6 calculations are a key part of the mechanical construction, as the (X, Y) values may be thought of as a cycloid-shaped template which the ramp surface must be forced to fit. Thus, the points 31 through 37 are to be used during cycloid ramp manufacture to judge the closeness of forcing the physical ramp surface to the desired cycloid section shape by measuring against the (X, Y) values for these points. Herein, substantially close or substantially coincident with means within 0.3 cm (⅛ in.). If the 7 reference values 31 to 37 substantially agree with those of FIG. 6, then for ramp materials of ordinary rigidity the intermediate points between points 31 to 37 will also substantially coincide with the other (X, Y) values from FIG. 6.

FIG. 10 shows one way to construct the first section 29 of the cycloid ramp. This ramp section is shown in the shipping position with the legs folded. The ramp support members are pairs of support legs. FIG. 11 shows detail of the upper part of section 29. The main leg pair 38 are hinged by hinge 51 to the bottom of section 29. See FIGS. 7 and 8 for this hinge position relative to starting point 31. The ramp is composed of 4 lanes which are joined side-by-side by some appropriate technique common in the art. The main support leg pair have cross braces shown as 48 and 50. There is a hinge block 46 which supports a hinge 47. This hinge 47 anchors the locking brace 39 to lock the main support leg pair 38. The main leg pair 38 are connected to the ramp by means of a hinged foldable brace pair 41. A cross piece 49 allows the hinged braces to apply a uniform downward force on the bottom of the ramp when the main leg pair is extended. A smaller secondary support leg pair 40 with cross brace 42 is also hinged to the first ramp section 29 bottom. The support point X, Y where leg pair 40 is applied is for an X where Y is on or between 0.28 h and 0.32 h.

Operation of Preferred Embodiment—FIGS. 12, 13, 14, and 15

Figure 12:
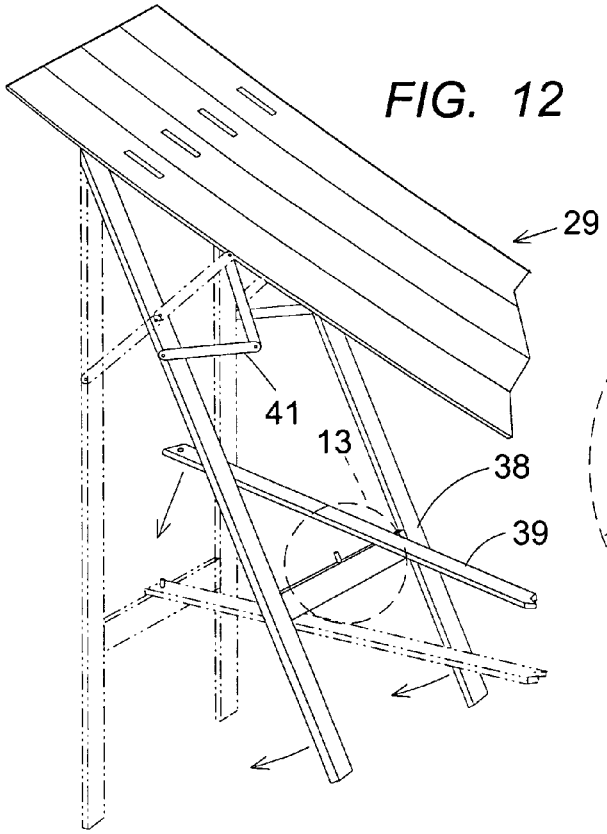
FIG. 12 shows a top perspective view of the drop down main legs.
Figure 13:
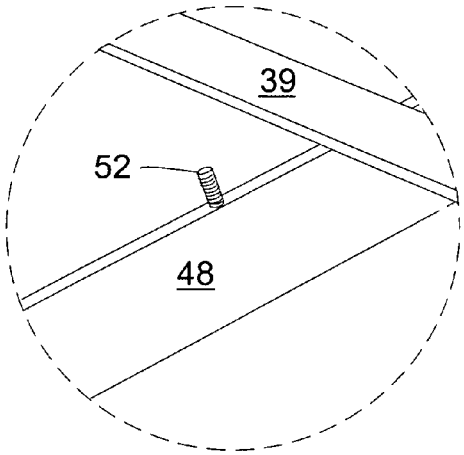
FIG. 13 shows a magnified view of the main support legs brace.
Figure 15:
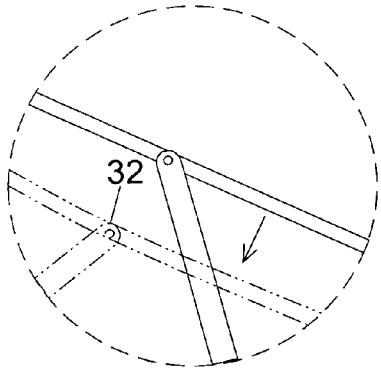
FIG. 15 shows a magnified view of the leg locking brace in FIG. 14.

The operation of the preferred embodiment also includes testing during manufacture to precisely specify and determine lengths and attachment points of certain support members. FIG. 12 shows how to unfold the main support leg pair 38 as shown previously in the shipping position of FIG. 10. In FIG. 12 the leftmost part of the ramp, the first section 29, is shown. As the main support leg pair 38 are pulled towards the vertical position, a downward force is applied by the hinged braces 41 to the underside of the ramp at point 32 (see also FIG. 6). When the main leg pair 38 are vertical, the hinged locking brace 39 is lowered. FIG. 13 shows the brace, having a hole at its leftmost end that fits over a threaded anchor bolt 52 in the main leg pair's 38 bottom brace 48, thus locking 38. A wing nut (not shown) is then be applied to anchor bolt 52 shown in the magnified view of FIG. 13.

Figure 14:
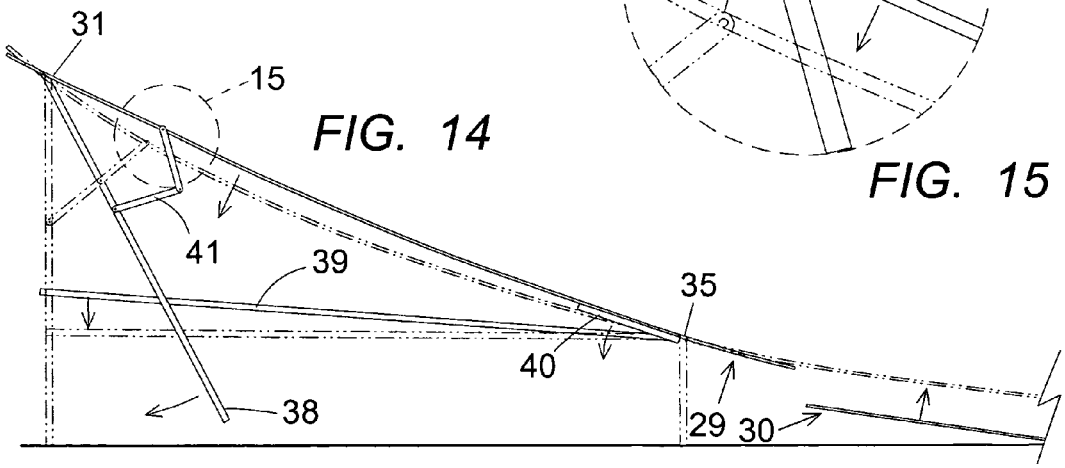
FIG. 14 shows a side view of the cycloid ramp with before and after movement.

FIG. 14 shows a side view corresponding to FIG. 12 and FIG. 9. The lowering of the main leg pair 38 distorts the natural profile of the entire ramp first section to closely follow a cycloid curve as shown by the phantom lines. Thus, the downward force of the hinged brace pair 41 applied between the two upward forces of the main leg pair 38 at point 31 and the secondary leg pair 40 at point 35 causes the natural ramp profile to arc under the bending force. Normally, the length of the hinged brace pair 41 is adjusted to produce the 95.50 cm ramp surface height at point 32, shown in detail in FIG. 15. FIG. 6 shows that point 32 is at a distance from the physical ramp top end equal to 1.99 ft or 25% of the section 29 length. Point 32 has been found by testing on wooden plywood ramps of a nominal 1.27 cm (0.5 in.) thickness and on prior art extruded aluminum ramps of a nominal 0.3 cm (0.125 in.) thickness to be the best point for application of the downward bending force to cause points 33 and 34, immediately below point 32, to substantially coincide with the proper X, Y. But, depending on the natural stiffness of the particular ramp material used, the point where the cross piece 41 is attached to the underside of the ramp may need to be moved either to the left or to the right of point 32 by a small amount not to exceed plus or minus 5% of the section 29 length in order that the subsequent ramp surface points 33 and 34 immediately below point 32 are substantially close to the cycloid heights as provided in FIG. 6. If the ramp attachment point is moved left or right of point 32, say to row 5 in FIG. 6, the final locked position of the ramp surface must still have the proper (X, Y) values for the new height of Y=0.84 h. The factory testing must adjust the length of the braces 41 to make this occur. Substantially as used herein means within 0.3 cm (⅛ in) of the FIG. 6 (X, Y) values. The downward force applied at point 32, shown in FIG. 6 as 1.99 ft (60.66 cm) from the top end of the physical ramp, is substantially close to 25% of the ramp section length. FIG. 14 shows that during application of this force, the tip of the ramp above fixed point 31 will rotate around the hinge pin of hinge 51 (FIG. 8) to a somewhat higher position, essentially continuing the cycloid curvature several inches to the left of the mathematical start of the cycloid at point 31. Also under application of the above downward force, the bottom end of the ramp section 29, below fixed point 35, will rotate upward around the hinge pin securing the deployed leg pair 40. FIG. 14 also shows ramp section 30 being raised to be smoothly joined to section 29 by methods common to the art. Actually section 30 could already have been joined to section 29 before legs 38 and 40 are lowered. The second ramp section 30 will then continue the cycloid curvature past the joining point but needs very little curvature itself, its maximum height being only about 25% of the starting height above the horizontal reference plane. The ramp height of points 35 and 36 will be substantially close to those listed in FIG. 6 by making the secondary leg pair 40 have a proper height and positioning leg pair 40 at horizontal distance X equivalent to a Y on or between 0.32 h and 0.28 h. If the stiffness of second ramp section 30 is low, floor support including the short leg 42 (FIG. 9) is used. The bending force applied to the ramp section 29 creates a tension that eliminates possible ramp sag under the weight of the gravity-driven cars. Because the above specification is somewhat involved, a summary is in order regarding forcing the ramp surface to substantially coincide with the cycloid section:

Preferred Embodiment Operation Summary:

The (X, Y) coordinate numbers give X in centimeters, Y in terms of h, for ramp surface points referred to a cycloid section having Y=h=119.38 at X=0 and Y=0 at X=d=456.42. Y values are measured above a horizontal plane as defined for point 37 below.

Point 31—An (X, Y) coordinate of (0, h) as fixed by the length of the main support member.

Point 32—An (X, Y) coordinate of (44.34, 0.8 h) as fixed by final position, length, and ramp attachment point of support brace. Attachment point could be moved slightly up or down ramp, and brace length adjusted, if the move improves (X, Y) coincidence of points 33 and 34.

Point 33—Also moves down to substantially coincide with (96.29, 0.8 h) as a result of bending moments applied by upward forces at point 31 and 35 and downward force at point 32.

Point 34—Also moves down to substantially coincide with (145.82, 0.44 h) as a result of bending moments applied by upward forces at point 31 and 35 and downward force at point 32.

Point 35—At an (X, Y) coordinate of (190.15, 0.32 h), but could be moved as far as (206.91, 0.28 h) if point 33 and point 34 coincidence with (X, Y) is improved.

Point 36—Comprises a small ramp support member at (321.91, 0.08 h).

Point 37—An (X, Y) coordinate of (456.42, 0), the Y=0 being set at the height of a horizontal reference plane marking the end of the entire ramp surface, such a plane also aligned with the surface of a coasting run installed as a continuation of the ramp surface as in FIG. 4.

DETAILED DESCRIPTION OF ALTERNATE EMBODIMENTS

FIGS. 16A, 16B, 16C, 16D, 16E, 16F, 16G, and 16H.

In the following alternate embodiments, the mathematical procedure for deriving points on the cycloid section curve is the same as in FIG. 6 in the preferred embodiment. The alternate embodiments therefore apply primarily to various support means to enable the ramp during factory assembly and deployment by the end user to match the derived cycloid shape.

Figure 16A:
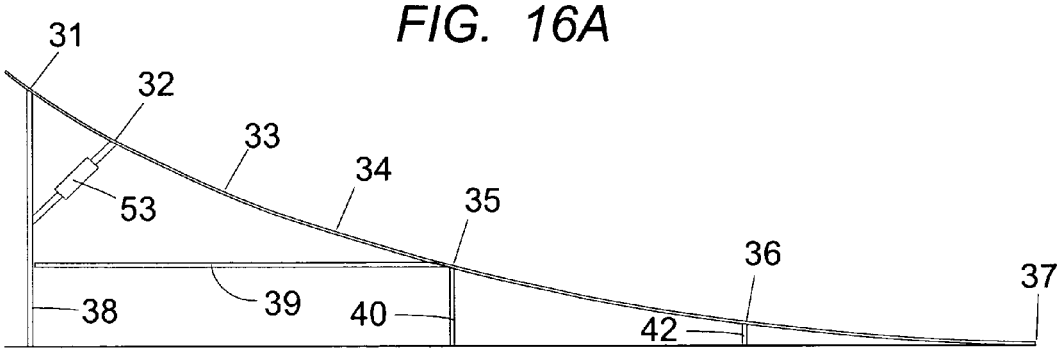
FIG. 16A shows an alternate embodiment of the cycloid ramp.

FIG. 16A duplicates the preferred embodiment as shown in FIGS. 4, and 9 through 15, except the foldable braces 41 are replaced by one or several turnbuckles 53 to apply the third downward force. One end of the turnbuckle is connected to the main pair of legs 31 and the other end connected to the ramp at point 32. In this embodiment, after the main support legs 38 are deployed and locked, and after the secondary legs 40 are deployed, the turnbuckle is attached and tightened to bend the ramp first section into the cycloid shape. The turnbuckle device is for those ramps with a structure too stiff for bending with the foldable braces of the preferred embodiment. For clarity, ramp section reference numbers 29 and 30 are omitted from FIG. 16A.

Figure 16B:
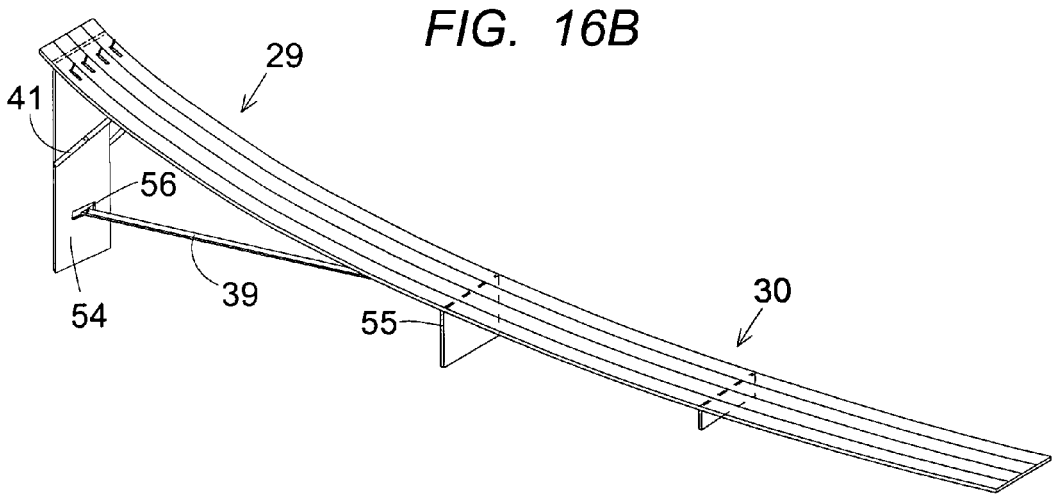
FIG. 16B shows a second alternate embodiment of the cycloid ramp.

FIG. 16B is a duplicate of the preferred embodiment as shown in FIGS. 4, and 9 through 15, except the leg pairs are replaced by functionally equivalent rigid sheets 54 and 55 of a suitable dimension to act as ramp supports. In a main support 54, a hole 56 is cut in the rigid sheet to accommodate the end of the locking brace 39.

Figure 16C:
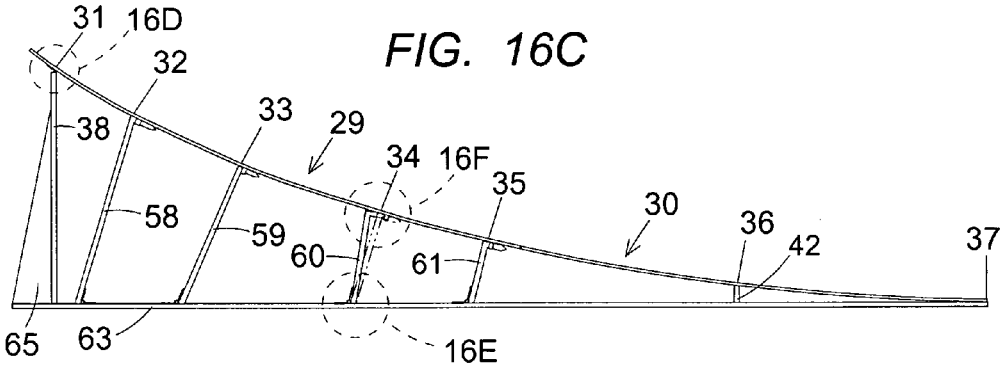
FIG. 16C shows a third alternate embodiment of the cycloid ramp.
Figure 16D:
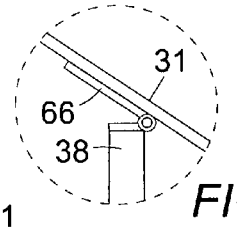
FIG. 16D shows a third alternate embodiment of the cycloid ramp.
Figure 16E:
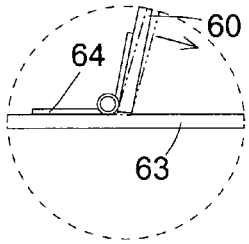
FIG. 16E shows a magnified support member hinged motion of FIG. 16C.
Figure 16F:
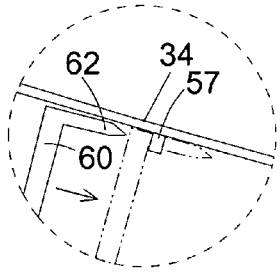
FIG. 16F shows a magnified support member hinge connection of FIG. 16C.

FIG. 16C shows a ramp side view where the support means consists of several floor support members, with the members being connected to a common horizontal rigid sheet, here a base board 63. The ramp is still composed of two equal sections 29 and 30 as in the preferred embodiment of FIG. 4. Thus, section 29 ends just to the right of the support point 35, and is smoothly joined to section 30 as is common in the art. This embodiment covers the situation where several extra ramp support points are needed in those cases where the ramp material of the first ramp section 29 is not able to easily bend into a cycloid section shape using the support member arrangement of the preferred embodiment. In the preferred embodiment, only two upward forces and one downward force are used. In FIG. 16C, several forces applied by several support members are used. In FIG. 16C, at starting point 31, the height h is still as in FIG. 6, and the ramp is firmly attached to the support member 38 but is still able to rotate about this support point. Thus, in FIG. 16D, a hinge 66 is shown connecting the ramp to the top of the support member 38 while allowing ramp rotation beneath the surface starting point 31. A fixed brace 65 keeps the support member 38 vertical relative to the base board 63. All other first ramp section support members, 58, 59, 60, and 61 are hinged at the bottom to the top of the base board. Only one short support member 42 is shown under the second ramp section 30 supporting point 36 although in principle others could be added if needed to give proper FIG. 6 values. The tops of support members 58, 59, 60, and 61 all have a protuberance 62 as seen in FIG. 16F which is made to rotate into a restraining bracket 57 firmly attached to the underside of the ramp at a preselected point. The ramp support member 60 is detailed in FIG. 16E and FIG. 16F to show the attachment mechanics for all support members 58, 59, 60, and 61. FIG. 16E shows the support member 60 with a hinge 64 holding the member firmly to the base board 63 but still allowing support member rotation. As mentioned, FIG. 16F shows the support member 60 top being slipped into an attachment bracket 57 just below ramp surface point 34. The first action during ramp setup and assembly is to attach support 38 and brace 65. Then an external force is applied to bend the ramp at point 32 while the hinged support member 58 is rotated and slipped into its restraining bracket firmly attached to the bottom of the ramp. In this fashion, sequentially all points 32, 33, 34, and 35 can be made substantially coincident with the cycloid (X, Y) points of FIG. 6 without regard to whether or not the support forces are up or down.

FIG. 16 G shows an embodiment where support for a cycloid ramp is by a box-like structure that will allow a large number of support attachments to a ramp in order to force the ramp to precisely conform to as many cycloid points as desired. Precisely as used herein means to within plus or minus 0.1 cm (0.040 inch). Here the floor support members are 4 rigid longitudinal sheets of a suitable thickness that are arranged perpendicularly to the floor. These rigid sheets have a precut curve at the top that matches the cycloid curve section as defined by the starting point, endpoint, and all intermediate points as given by as many (X, Y) values as one wishes to calculate according to the mathematical methods that resulted in FIG. 6. As shown in FIG. 16G the support structure is divided into two sections to support the ramp, which is still formed of two sections of equal length as shown. The essentially continuous support structure comprises continuous upright rigid sheets, 67, 68, 69, and 70. Here essentially continuous support means the support is only broken into 2 equal length separate parts that are brought together during assembly. Functionally the sheet pairs 67, 69 and 68, 70 could be joined as only 2 upright rigid sheets but shipping and handling would be comprised with such an embodiment because of the 4.877 meters (16 ft.) overall length.

Figure 16G:
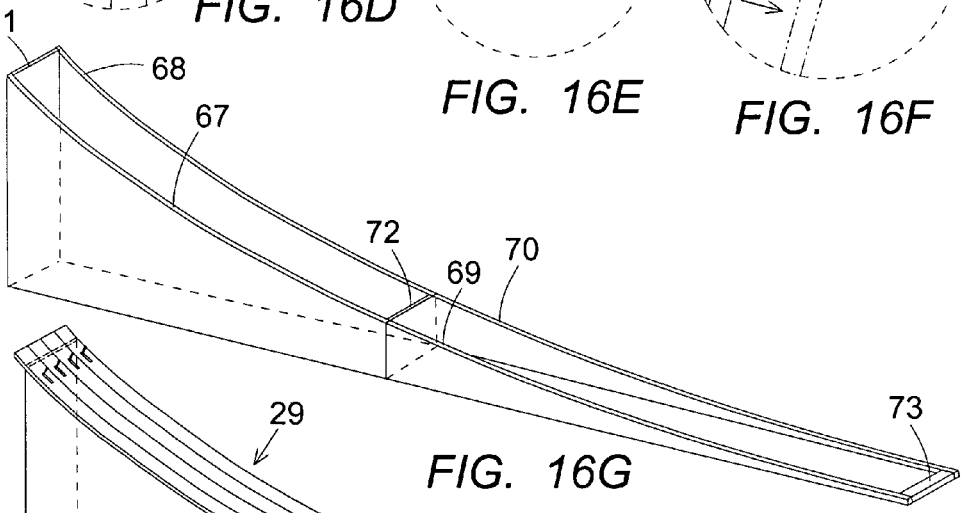
FIG. 16G shows a fourth alternate embodiment support structure of the cycloid ramp.

The structure of FIG. 16G also includes several cross pieces of rigid sheets connected between and perpendicular to the rigid longitudinal upright sheets to form a free standing box structure of parallel sides with the precut cycloid curve exposed at the top. In FIG. 16G there is shown a main cross piece 71, a central cross piece 72, and an end cross piece 73.

Figure 16H:
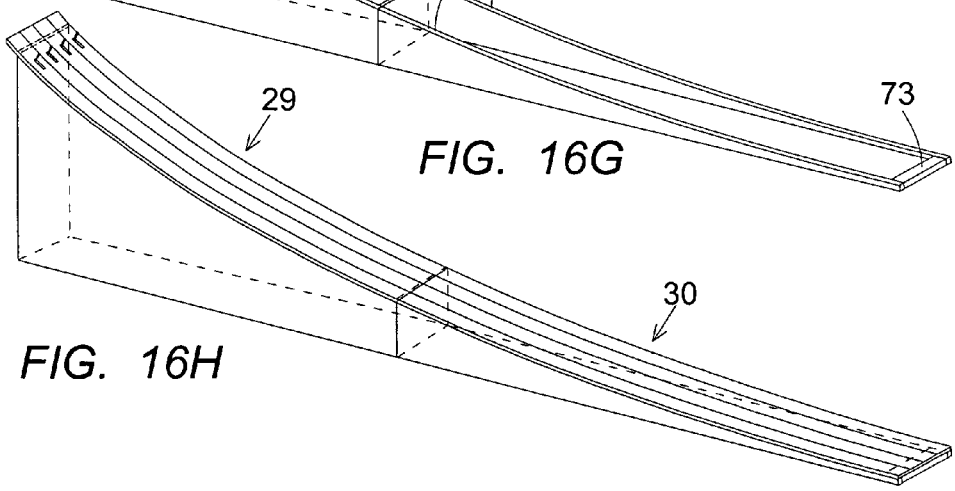
FIG. 16H shows the complete fourth alternate embodiment of the cycloid ramp.

FIG. 16H shows ramp sections 29 and 30 on top of the support structure of FIG. 16G. The ramp sections are fastened to the support structure by methods common to the art.

Advantages

From the above description, advantages to the cycloid shaped ramp are as follows:

(a) The preferred embodiment is factory assembled, requiring no tools for support set up.
(b) All embodiment support structures put the ramp under tension, allowing no distortion because of car weight.
(c) There is no excess centripetal force to cause oscillations contributing to car instability.
(d) There is no excess centripetal force to cause bending of small diameter speed axles.
(e) The smoothest possible transition from ramp acceleration into the coasting run is guaranteed.
(f) The design can assist in the teaching of the Brachistichrone and the cycloid curve principles to youngsters.
(g) The cycloid shaped ramp enhances high speed precision gravity-driven car racing.

Conclusions, Ramifications, And Scope

The reader can see that the described embodiments of the cycloid ramp apply a rather ancient principle of a least time curve to a gravity-driven car ramp. But even more important than having a ramp that gives the fastest possible time is the fact that a cycloid shaped ramp guarantees the least possible centripetal force on a gravity-driven car as it drops from the starting height to the horizontal coasting run. Any other shape, i.e., a ramp that curves too much at the top compared to the bottom, or a ramp that curves too much at the bottom compared to the top, will have a larger centripetal force on the car at some point on the ramp as compared to a cycloid curve shape. Prior art ramp builders simply did not appreciate, or were not aware of, the benefits of the cycloid curve as a ramp shape. The low centripetal force means the car can perform to its full capability by entering the coasting run in the smoothest fashion possible. When an excessive centripetal force pushes the car mass down on the rear axles, the wheel-on-axle force increases in proportion. But axle lubrication is not perfectly uniform, so that one of the car's rear wheel's frictional drag will increase compared to the other rear wheel creating a torque that twists the lightly-loaded front wheels to one side. This causes a car oscillation to start and the car to bump into the guide rails and lose speed. Also, a car's rear, where most of the weight is placed, may have more weight on one side than the other. Although the net frictional drag is unchanged, a similar torque is produced that tends to twist the car front to the weighted side. Thus, even with uniform rear wheel lubrication, an increase in centripetal force may cause enough extra torque to cause the front wheels to break loose from straight tracking. This behavior is not found in normal car testing, because cars that are tested for straight tracking are under normal weight on a level coasting run and are not subject to the effects of an excessive centripetal force.

Rather complicated equations have been mathematically and graphically solved to select the proper cycloid that will fit a certain starting height and become tangent to the coasting run at a certain specified horizontal distance. This application teaches the associated mathematics in a coherent easy-to-follow format. Moreover, as youngsters build and race cars, they will be exposed to the cycloid curve in action and its rich scientific history. The preferred embodiment demonstrates a unique method of applying a ramp-curving, hinged brace in order to pull the ramp into a cycloid as the main support legs are deployed. Although the stiffness of a ramp may change, because of its thickness, its material, or its number of lanes, several alternate embodiments are shown that will be able to form any ramp structure to the proper cycloid shape.

This application is an extension of already filed application Ser. No. 12/321,320 which improves the mechanical aspects of a race start gate, and application Ser. No. 12/455,796 which improves the electrical race start signal timing. These two applications, plus the present one, all used together on one race track, will significantly improve the accuracy and fairness of the popular pinewood derby races which are run on such a track.

While the above invention contains many specificities, these should not be construed as limitations on the scope of any other possible embodiments, but rather as examples of the presently presented embodiments. Thus the scope of the invention should be determined by the appended claims and their legal equivalents, and not by the descriptive examples given.

I claim:

1. An improved race track ramp, for one or a plurality of gravity-driven cars, comprising (a) a ramp cycloid section and a ramp support structure, said ramp cycloid section further comprising one or a plurality of identically elevated and sloped contiguous lanes, upon which wheels of said cars roll on a lane rolling surface, and said ramp cycloid section capable of having a curvature being that of a cycloid curve section, said curvature established by said ramp cycloid section being urged to assume the shape of said cycloid curve section by interacting with said support structure;

(b) said cycloid curve section being a continuous section of a cycloid curve, said cycloid curve section having a predetermined start point and a predetermined end point, said cycloid curve section being the shortest possible trajectory traced out by said car wheels on the top surface of said lanes of said ramp cycloid section;

(c) thus specification of a curve parameter describing said cycloid curve section, being itself a two-dimensional curve, applies as well to any of said identical lanes of the entire three-dimensional said ramp cycloid section, whereupon said predetermined start point and said predetermined end point of said cycloid curve section apply as well to a ramp cycloid section start point and a ramp cycloid section end point of the three-dimensional said ramp cycloid section;

(d) said ramp cycloid section being part of an overall race track that also comprises a coasting run, said coasting run being a straightforward continuation of said ramp cycloid section and said lane rolling surface of said coasting run being coincident with a horizontal reference plane, said reference plane having a flat and level surface;

(e) said ramp cycloid section further comprising a first, higher ramp section, and a second, lower ramp section, said first ramp section and said second ramp section being joined end-to-end to form said ramp cycloid section;

(f) in order to determine specific features of said ramp support structure and its interaction with said ramp cycloid section to cause it to have said curvature being that of said cycloid curve section, one should be familiar with certain mathematical characteristics of said cycloid curve that will allow one to produce the horizontal and vertical distances to which said ramp cycloid section must conform;

(g) said cycloid curve being a curve traced out by movement of a generating point fixed on the circumference of a circle, having a radius r, as said circle is being rotated by a rolling action, without slipping, horizontally in a right-handed sense as defined as the positive forward travel direction of said cars when viewing from their passenger side, said rolling action being along the underside of a straight horizontal x-axis, with the circumference of said circle being under and against said horizontal x-axis, and a rotation of said circle during said rolling action being measured by a rotation angle θ;

(h) said cycloid curve further being mathematically described in terms of a parameter pair which consists of said radius r and said rotation angle θ, said parameter pair defining a horizontal distance x of a point on said cycloid curve according to an equation (1) and $$x = r(\theta - \sin\theta) \tag{1}$$

$$y = r(1 - \cos\theta) \tag{2}$$

further defining a vertical distance y of said point on said cycloid curve, measured positive downwards, according to an equation (2), and said equation (1) and said equation (2), together, being mathematically known as a pair of parametric equations of said cycloid curve;

(i) said equation (1), and said equation (2), thereby defining a cartesian coordinate pair x and y, denoted as (x,y), being used for locating any of a multitude of points on said cycloid curve, said cycloid curve multitude of points having a start point at an origin, said origin denoted as (0,0) with said cartesian coordinate pair x and y each being 0, and at said origin said rotation angle θ also being 0 before said generating point starts tracing said cycloid curve;

(j) said cycloid curve initially dropping sharply from said origin (0,0), and with gradually reducing curvature proceeding in said right-handed sense, as said circle rolls, until said cycloid curve drops below said x-axis a maximum y distance $y_m$, there said cycloid curve becoming tangent, at a maximum x distance $x_m$, to a horizontal straight line through $y_m$, thereby defining said ramp cycloid section end point as $(x_m, y_m)$;

(k) said horizontal straight line through $y_m$ also lying in said horizontal reference plane, said plane being located at said distance $y_m$ below said origin (0,0), therefore said ramp cycloid section, having said predetermined end point at $(x_m, y_m)$, being suitable for smoothly joining to said coasting run;

(l) starting from directly below said ramp cycloid section start point, and measuring a ramp length d along said horizontal reference plane in the car travel direction, will locate said ramp cycloid section end point at $(x_m, y_m)$ and define said ramp length d;

(m) said ramp cycloid section start point, being measured vertically upwards from said horizontal reference plane, is at a ramp start height h;

(n) said predetermined start point on said cycloid curve that also marks said ramp cycloid section start point being hereby denoted by a cartesian coordinate pair $(x_o, y_o)$ that correspond to an initial value for said rotation angle $\theta_o$, said ramp cycloid section start point having a x value $x_o$ and a y value $y_o$ being defined by an equation (3) and an equation (4), said equations obtained respectively from said equation (1) and said equation (2);

$$x_0 = r(\theta_0 - \sin\theta_0) \tag{3}$$

$$y_0 = r(1 - \cos\theta_0 \tag{4}$$

(o) said gravity-driven cars having a starting position with the center of each of said cars, as placed in their said lane, being positioned on a line being perpendicular to said ramp cycloid section and passing through said ramp cycloid section start point $(x_o, y_o)$, and further an extension being added above said ramp cycloid section, said extension extending opposite the racing travel direction and towards the rear of said cars, being behind said start point, said extension being for supporting the rear wheels of said cars, said extension being defined as a simple ½ car-length distance, said extension having a slope substantially the same as said slope at said ramp start point and said extension not being considered part of said ramp cycloid section as considered herein;

(p) said ramp cycloid section being more conveniently described by defining a horizontal ramp cycloid section coordinate X and a vertical ramp cycloid section coordinate Y with each being shifted a predetermined amount from said cartesian coordinates x and y, said horizontal ramp cycloid section coordinate X being 0 at said ramp cycloid section start point and increasing to said ramp length d at said ramp cycloid section end point, and further said vertical coordinate Y being measured positive from above said horizontal straight line through $y_m$, said horizontal line being located in said horizontal reference plane, said coordinate Y being said ramp start height h at said ramp cycloid section start point and decreasing to 0 at said ramp cycloid section end point, said coordinate X and said coordinate Y taken together called a ramp coordinate pair (X, Y), being mathematically described by an equation (5) and an equation (6), with $x_o$ being defined as in said equation (3) and $y_m$, being said maximum $$X=x-x_o \tag{5}$$

$$Y=y_m-y \tag{6}$$

distance of y;

(q) said equation (3) requiring $x_o$, and said equation (4) requiring $y_o$, being put in terms of given quantities, namely said ramp start height h and said ramp length d, thus x goes from zero to $x_o$, where said ramp starts, and continues on an amount being said ramp length d to $x_m$ at which point said circle's said generating point has rolled $\pi=180°$ for a distance $x_m=\pi r$, thus an equation (7) below results, and said maximum y distance $y_m$ being just the diameter 2 r of said circle, and this amount, less said start height h, giving an equation (8) wherein y having said y value $y_o$ as measured downward starting from y=0 and ending at said ramp start height h, thus $$x_o=\pi r-d \tag{7}$$

$$y_o=2r-h \tag{8}$$

with $x_o$ and $y_o$ now being in terms of r, d and h;

(r) said equation (3) and said equation (4) being put in terms of h and d by substituting for $x_o$ and $y_o$ using said equation (7) and said equation (8) respectively, giving an equation (9) and an equation (10)

$$\pi r-d=r(\theta_0-\sin\theta_0) \tag{9}$$

$$2r-h=r(1-\cos\theta_0) \tag{10}$$

and then solving said equation (9) and said equation (10) for r giving $$r=\frac{d}{\Pi-\theta_0+\sin\theta_0} \tag{11}$$

$$r=\frac{h}{1+\cos\theta_0} \tag{12}$$

where an equation (11) and an equation (12) above being independent expressions for r;

(s) one needs to solve said equation (11) and said equation (12) for said circle radius r and for said $\theta_0$ value, being given a particular ramp start height h and a particular ramp length d from a preferred embodiment, it being customary in the art for a car center start height being substantially 4 ft, thus also allowing for a 2.5 cm=1-inch ramp thickness one can choose said lane surface of said ramp cycloid section as having said particular ramp start height h as being 1 inch less at h=119.38 cm or 47.00 inch, and also it being customary in the art for an uncurved ramp length being substantially 16 ft=487.68 cm, but after being projected on said horizontal plane, in effect creating a ramp shadow, said shadow being substantially 1 foot= 30.5 cm less giving said particular ramp length d=15 ft=456.42 cm, thus with said particular ramp start height h and said particular ramp length d being chosen at these particular values by an art practitioner, one proceeds to solve said equation (11) and said equation (12), these being in parametric form thus requiring a graph-based solution being carried out for said parameter pair r and $\theta_0$ by plotting a pair of graph-based curves, one for each of said equation (11) and said equation (12), said graph-based curves having mutually perpendicular axes for each of said parameter pair r and $\theta_0$ and further noting said curves cross at a specific r value, r=238.40 cm, and a specific $\theta_0$ value, $\theta_0=119.95°$ or 2.0938 rad, said specific r value and said specific $\theta_0$ value being input to said equation (7) and said equation (8) giving an equation (13) and an equation (14) below, $$x_o=\pi r-d=292.53\text{cm} \tag{13}$$

$$y_0=2r-h=357.42\text{ cm} \tag{14}$$

said equation (13) and said equation (14) then giving said ramp cycloid section start point having said cartesian coordinate pair $(x_o,y_o)$;

(t) using said ramp coordinate pair X and Y for describing said ramp cycloid section start point, one has from said equation (5) and said equation (6) that X=0 and Y=h=119.38 cm;

(u) for an example of calculating said ramp coordinate pair X and Y at an arbitrary point on said ramp cycloid section, one chooses a Y value height, say at 80% of said particular ramp start height h, thus said Y=95.5 cm and one gets a specific y value y=2r−0.8h=381.30 cm from said equation (6), then rearranging said equation (2), resulting in an equation (15) below, and putting said specific y value and said specific r value into said equation (15), thus getting a $$\theta=\cos^{-1}\left(1-\frac{y}{r}\right) \tag{15}$$

$$x=r(\theta-\sin\theta) \tag{1}$$

resulting θ value of θ=2.214 radians, said resulting θ value being input into said equation (1), reproduced here for convenience, giving x=336.88 cm, and from said equation (5) one gets a value X=44.34 cm, thus at a horizontal distance of 44.34 cm from directly below said ramp start point, said Y value height being 95.5 cm, and said example being repeated to give said horizontal displacement distance X for any given height Y of said arbitrary point, thereby creating a table of (X, Y) distances based on multiple determinations of said ramp coordinate pair (X, Y);

(v) whereby, after having selected values for said ramp start height h and said ramp length d, and also having obtained values for said parameter pair r and θ, these being available from said graph-based solution of said equation (11) and said equation (12), said art practitioner then being able to produce said horizontal coordinate X and said vertical coordinate Y for any of said arbitrary points on said ramp cycloid section between said ramp start point and said ramp end point, thus providing said table of (X, Y) distances with which said art practitioner can cause said ramp to conform to during construction and set-up of said ramp.

2. The ramp of claim 1, wherein said ramp support structure urges said ramp cycloid section to assume the shape of, and substantially conform to, said cycloid curve section by using one or a plurality of ramp support members.

3. The ramp of claim 2, wherein said one or a plurality of ramp support members comprise one or a plurality of floor support members, extending from a level floor to the underside of said ramp cycloid section, said level floor substantially coincident with said horizontal reference plane, and said one or a plurality ramp support members further comprising one or a plurality of lockable and foldable hinged braces that extend from the underside of said ramp first section to a predetermined floor support member.

4. The ramp of claim 3, wherein said one or a plurality of floor support members comprise a main floor support member providing support to keep a first point on said lane surface of said first ramp section substantially coincident with said ramp start point at height h, and also comprise a secondary floor support member, of predetermined length, providing support to keep a second point on said ramp first section surface substantially coincident with said ramp coordinate pair (X, Y), where Y is in a range between 0.28 h and 0.32 h, and X is numerically obtained from said table of (X, Y) distances and further, said floor support members being hinged to, and capable of being folded underneath, said first ramp section.

5. The ramp of claim 4, wherein against the underside of said first ramp section a first upward force and a second upward force are applied, in reaction to a third downward force, said first force applied by said main floor support member, said first force keeping said first point on said first ramp section at said start height h, and said second force, applied by said secondary support member, keeping said second point coincident with said ramp coordinate pair(X, Y), Y being between 0.28 h and 0.32 h.

6. The ramp of claim 5, wherein said third downward force, being applied between said first upward force and said second upward force, causing said first ramp section to curve, said ramp approaching said cycloid curve section, with said third force being applied by said one or a plurality of lockable and foldable, hinged braces, a bottom end pivot point of said braces being pivoted to said main floor support member and the other end of said braces being pivoted to said first ramp section at a ramp brace attachment point of substantially 25% of the distance, in said right-handed sense, from said first point to said second point, said third force being activated when said main floor support member is being lowered from underneath said first ramp section and locked in a vertical position by a horizontal locking brace and by a locking action of said one or a plurality of lockable and foldable hinged braces, the length of said braces, said bottom end pivot point on said main support member, and said ramp brace attachment point all being predetermined to cause said ramp coordinate pair (X, Y) measurement of said lane rolling surface immediately above said ramp brace attachment point to substantially coincide with said ramp coordinate pair as determined from said table of (X, Y) distances.

7. The ramp of claim 3, wherein support of said second ramp section is comprised of one of said one or a plurality of floor support members, said floor support member positioned at a predetermined point X beneath said second ramp section to cause said lane rolling surface height immediately above said predetermined point X to substantially coincide with said vertical coordinate Y from said table of (X, Y) distances.

8. The ramp of claim 3, wherein said floor support members comprise a pair of rigid legs, each member of said leg pair being of equal length.

9. The ramp of claim 3, wherein said floor support members comprise one or a plurality of stiff sheets being rigid and of predetermined dimension.

10. An improved race track ramp, for one or a plurality of gravity-driven cars, comprising (a) a ramp cycloid section and a ramp support structure, said ramp cycloid section further comprising one or a plurality of identically elevated and sloped contiguous lanes, upon which wheels of said cars roll on a lane rolling surface, and said ramp cycloid section capable of having a curvature being that of a cycloid curve section, said curvature established by said ramp cycloid section being urged to assume the shape of said cycloid curve section by interacting with said support structure;

(b) said cycloid curve section being a continuous section of a cycloid curve, said cycloid curve section having a predetermined start point and a predetermined end point, said cycloid curve section being the shortest possible trajectory traced out by said car wheels on the top surface of said lanes of said ramp cycloid section;

(c) thus specification of a curve parameter describing said cycloid curve section, being itself a two-dimensional curve, applies as well to any of said identical lanes of the entire three-dimensional said ramp cycloid section, whereupon said predetermined start point and said predetermined end point of said cycloid curve section apply as well to a ramp cycloid section start point and a ramp cycloid section end point of the three-dimensional said ramp cycloid section;

(d) said ramp cycloid section being part of an overall race track that also comprises a coasting run, said coasting run being a straightforward continuation of said ramp cycloid section and said lane rolling surface of said coasting run being coincident with a horizontal reference plane, said reference plane having a flat and level surface;

(e) said ramp cycloid section further comprising a first, higher ramp section, and a second, lower ramp section, said first ramp section and said second ramp section being joined end-to-end to form said ramp cycloid section;

(f) in order to determine specific features of said ramp support structure and its interaction with said ramp cycloid section to cause it to have said curvature being that of said cycloid curve section, one should be familiar with certain mathematical characteristics of said cycloid curve that will allow one to produce the horizontal and vertical distances to which said ramp cycloid section must conform;

(g) said cycloid curve being a curve traced out by movement of a generating point fixed on the circumference of a circle, having a radius r, as said circle is being rotated by a rolling action, without slipping, horizontally in a right-handed sense as defined as the positive forward travel direction of said cars when viewing from their passenger side, said rolling action being along the underside of a straight horizontal x-axis, with the circumference of said circle being under and against said horizontal x-axis, and a rotation of said circle during said rolling action being measured by a rotation angle θ;

(h) said cycloid curve further being mathematically described in terms of a parameter pair which consists of said radius r and said rotation angle θ, said parameter pair defining a horizontal distance x of a point on said cycloid curve according to an equation (1) and further defining a vertical distance y of said point on said cycloid curve, measured positive downwards, according to an equation (2), and further, said equation (1) and said equation (2), $$x=r(\theta-\sin\theta) \quad (1)$$

$$y=r(1-\cos\theta) \quad (2)$$

together being mathematically known as a pair of parametric equations of said cycloid curve;

(i) said equation (1), and said equation (2), thereby defining a cartesian coordinate pair x and y, denoted as (x,y), being used for locating any of a multitude of points on said cycloid curve, said cycloid curve multitude of points having a start point at an origin, said origin denoted as (0,0) with said cartesian coordinate pair x and y each being 0, and at said origin said rotation angle θ also being 0 before said generating point starts tracing said cycloid curve;

(j) said cycloid curve initially dropping sharply from said origin (0,0), proceeding in said right-handed sense, as said circle rolls, with reducing curvature, until said cycloid curve drops below said x-axis a maximum y distance $y_m$, there said cycloid curve becoming tangent, at a maximum x distance $x_m$, to a horizontal straight line through $y_m$, thereby defining said ramp cycloid section end point as $(x_m,y_m)$;

(k) said horizontal straight line through $y_m$ also lying in said horizontal reference plane, said plane being located at said distance $y_m$, below said origin (0,0), therefore said ramp cycloid section, having said predetermined end point at $(x_m,y_m)$, being suitable for smoothly joining to said coasting run;

(l) starting from directly below said ramp cycloid section start point, and measuring a ramp length d along said horizontal reference plane in the car travel direction, will locate said ramp cycloid section end point at $(x_m,y_m)$ and define said ramp length d;

(m) said ramp cycloid section start point, being measured vertically upwards from said horizontal reference plane, is at a ramp start height h;

(n) said predetermined start point on said cycloid curve that also marks said ramp cycloid section start point being hereby denoted by a cartesian coordinate pair $(x_o,y_o)$ that correspond to a rotation angle $\theta_o$, said ramp cycloid section start point having a x value $x_o$ and a y value $y_o$ being defined by an equation (3) and an equation (4), $$x_0=r(\theta_0-\sin\theta_0) \tag{3}$$

$$y_0=r(1-\cos\theta_0) \tag{4}$$

said equations obtained respectively from said equation (1) and said equation (2);

(o) said gravity-driven cars having a starting position with the center of each of said cars, as placed in their said lane, being positioned on a line being perpendicular to said ramp cycloid section and passing through said ramp cycloid section start point $(x_o, y_o)$, and further an extension being added above said ramp cycloid section, said extension extending opposite the racing travel direction and towards the rear of said cars, being behind said start point, said extension being for supporting the rear wheels of said cars, said extension being defined as a simple ½ car-length distance, said extension having a slope substantially the same as said slope at said ramp start point and said extension not being considered part of said ramp cycloid section as considered herein;

(p) said ramp cycloid section being more conveniently described by defining a horizontal ramp cycloid section coordinate X and a vertical ramp cycloid section coordinate Y with each being shifted a predetermined amount from said cartesian coordinates x and y, said horizontal ramp cycloid section coordinate X being 0 at said ramp cycloid section start point and increasing to said ramp length d at said ramp cycloid section end point, and further said vertical coordinate Y being measured positive from above said horizontal straight line through $y_m$, said horizontal line being located in said horizontal reference plane, said coordinate Y being said ramp start height h at said ramp cycloid section start point and decreasing to 0 at said ramp cycloid section end point, said coordinate X and said coordinate Y taken together called a ramp coordinate pair (X,Y) and being mathematically described by an equation (5) and an equation (6), $$X=x-x_o \tag{5}$$

$$Y=y_m-y \tag{6}$$

with $x_o$ being defined as in said equation (3) and $y_m$, being said maximum distance of y;

(q) said equation (3) requiring $x_o$, and said equation (4) requiring $y_o$, being put in terms of given quantities, namely said ramp start height h and said ramp length d, thus x goes from zero to $x_o$, where said ramp starts, and continues on an amount being said ramp length d to $x_m$, at, which point said circle's said generating point has rolled $\pi=180°$ for a distance $x_m=\pi r$, thus an equation (7) below results, and said maximum y distance $y_m$, being just the diameter 2 r of said circle, and this amount, less said start height h, giving an equation (8) wherein y having said y value $y_o$ as measured downward starting from y =0 and ending at said ramp start height h, thus $$x_o=\pi r-d \tag{7}$$

$$y_o=2r-h \tag{8}$$

with $x_o$ and $y_o$ now being in terms of r, d and h;

(r) said equation (3) and said equation (4) being put in terms of h and d by substituting for $x_o$ and $y_o$ using said equation (7) and said equation (8) respectively, giving an equation (9) and an equation (10)

$$\pi r-d=r(\theta_0-\sin\theta_0) \tag{9}$$

$$2r-h=r(1-\cos\theta_0) \tag{10}$$

and then solving said equation (9)and said equation (10) for r giving $$r=\frac{d}{\Pi-\theta_0+\sin\theta_0} \tag{11}$$

$$r=\frac{h}{1+\cos\theta_0} \tag{12}$$

where an equation (11) and an equation (12) above being independent expressions for r;

(s) one needs to solve said equation (11) and said equation (12) for said circle radius r and for said $\theta_0$ value, being given a particular ramp start height h and a particular ramp length d from a preferred embodiment, it being customary in the art for a car center start height being substantially 4 ft, thus also allowing for a 2.5 cm=1- inch ramp thickness one can choose said lane surface of said ramp cycloid section as having said particular ramp start height h as being 1inch less at h=119.38 cm or 47.00 in, and also it being customary in the art for an uncurved ramp length being substantially 16 ft=487.68 cm, being projected on said horizontal plane, in effect creating a ramp shadow, said shadow being substantially 1 foot=30.5 cm less giving said particular ramp length d=15 ft=456.42 cm, thus with said particular ramp start height h and said particular ramp length d being chosen at these particular values by an art practitioner, one proceeds to solve said equation (11) and said equation (12), these being in parametric form thus requiring a graph-based solution being carried out for said parameter pair r and $\theta_0$ by plotting a pair of graph-based curves, one for each of said equation (11) and said equation (12), said graph-based curves having mutually perpendicular axes for each of said parameter pair r and $\theta_0$ and further noting said curves cross at a specific r value, r=238.40 cm, and a specific $\theta_0$ value, $\theta_0$ =119.95° or 2.0938 rad, said specific r value and said specific $\theta_0$ value being input to said equation (7) and said equation (8) giving an equation (13) and an equation (14) below, $$x_0=\pi r-d=292.53 \text{ cm} \tag{13}$$

$$y_0=2r-h=357.42 \tag{14}$$

said equation (13) and said equation (14) then giving said ramp cycloid section start point having said cartesian coordinate pair $(x_o,y_o)$;

(t) using said ramp coordinate pair X and Y for describing said ramp cycloid section start point, one has from said equation (5) and said equation (6) that X=0 and Y=h=119.38 cm;

(u) for an example of calculating said ramp coordinate pair X and Y at an arbitrary point on said ramp cycloid section, one chooses a Y value, say at 80% of said ramp start height h, thus said Y=95.5 cm and one gets a value y=2r−0.8h=381.30 cm from said equation (6), then rearranging said equation (2), resulting in an equation (15) below, and putting said y and r values into said equation (15), thus getting a resulting θ value of θ=2.214 radians, said θ value being input into said equation (1), reproduced here for convenience, giving x=336.88 cm, and $$\theta = \cos^{-1}\left(1 - \frac{y}{r}\right) \tag{15}$$

$$x=r(\theta-\sin\theta) \tag{1}$$

from said equation (5) one gets a value X=44.34 cm, thus at a horizontal distance of 44.34 cm from said ramp start point, said ramp should have a height of 95.5 cm, and said example being repeated to give distance X for horizontal displacement of any given height Y of said arbitrary point, thereby creating of a table of (X,Y) distances based on multiple determinations of said ramp coordinate pair (X,Y);

(v) whereby, after having selected values for said ramp start height h and said ramp length d, and having obtained values for said parameter pair r and θ, being available from said graph-based solution of said equation (11) and said equation (12), said art practitioner then being able to produce said horizontal coordinate X and said vertical coordinate Y for any of said arbitrary points on said ramp cycloid section between said ramp start point and said ramp end point, thus providing said table of (X,Y) distances with which said art practitioner can cause said ramp to conform to during construction and set-up of said ramp.

11. The ramp of claim 10, wherein said ramp support structure urges said ramp cycloid section to assume the shape of, and substantially conform to, said cycloid curve section by using one or a plurality of ramp support members.

12. The ramp of claim 11, wherein said one or a plurality of ramp support members comprise one or a plurality of floor support members, extending from a level floor to the underside of said ramp cycloid section, said level floor substantially coincident with said horizontal reference plane, and said one or a plurality ramp support members further comprising one or a plurality of turnbuckles that extend from the underside of said ramp first section to a predetermined floor support member.

13. The ramp of claim 12, wherein said one or a plurality of floor support members comprise a main floor support member providing support to keep a first point on said lane surface of said first ramp section substantially coincident with said ramp start point at height h, and also comprise a secondary floor support member, of predetermined length, providing support to keep a second point on said ramp first section surface substantially coincident with said ramp coordinate pair (X, Y), where Y is in a range between 0.28 h and 0.32 h, and X is numerically obtained from said table of (X,Y) distances and further, said floor support members being hinged to, and capable of being folded underneath, said first ramp section.

14. The ramp of claim 13, wherein against the underside of said first ramp section a first upward force and a second upward force are applied, in reaction to a third downward force, said first force applied by said main floor support member, said first force keeping said first point on said first ramp section at said start height h, and said second force, applied by said secondary support member, keeping said second point coincident with said ramp coordinate pair(X, Y), Y being between 0.28 h and 0.32 h.

15. The ramp of claim 14, wherein said third downward force being applied to the bottom of said first ramp section between said first upward force and said second upward force, said third force being applied by said one or a plurality of turnbuckles with said turnbuckles being pivoted to said main floor support member at a turnbuckle bottom end pivot point, and after deploying said main floor support member to a vertical position and locking in place with a horizontal locking brace, the other top end of said turnbuckles being connected at a ramp turnbuckle attachment point substantially 25% of the distance in said right-handed sense from said first point to said second point, with subsequent tightening of said turnbuckles causing said first ramp section to curve thus approaching said cycloid curve section, the length of said turnbuckles, said turnbuckle bottom end pivot point, and said ramp turnbuckle attachment point being predetermined to allow tightening of said turnbuckles to cause said ramp surface, immediately above said ramp turnbuckle attachment point, to substantially coincide with said ramp coordinate pair as determined from said table of (X,Y) distances.

16. The ramp of claim 12, wherein support of said second ramp section is comprised of one of said one or a plurality of floor support members, said floor support member positioned at a predetermined point X beneath said second ramp section to cause said lane rolling surface height immediately above said predetermined point X to substantially coincide with said vertical coordinate Y from said table of (X,Y) distances.

17. The ramp of claim 12, wherein said floor support members comprise a pair of rigid legs, each member of said pair being of equal length.

18. The ramp of claim 12, wherein said floor support members comprise one or a plurality stiff sheets of predetermined dimension.

19. An improved race track ramp, for one or a plurality of gravity-driven cars, comprising (a) a ramp cycloid section and a ramp support structure, said ramp cycloid section further comprising one or a plurality of identically elevated and sloped contiguous lanes, upon which wheels of said cars roll on a lane rolling surface, and said ramp cycloid section capable of having a curvature being that of a cycloid curve section, said curvature established by said ramp cycloid section being urged to assume the shape of said cycloid curve section by interacting with said support structure;

(b) said cycloid curve section being a continuous section of a cycloid curve, said cycloid curve section having a predetermined start point and a predetermined end point, said cycloid curve section being the shortest possible trajectory traced out by said car wheels on the top surface of said lanes of said ramp cycloid section;

(c) thus specification of a curve parameter describing said cycloid curve section, being itself a two-dimensional curve, applies as well to any of said identical lanes of the entire three-dimensional said ramp cycloid section, whereupon said predetermined start point and said predetermined end point of said cycloid curve section apply as well to a ramp cycloid section start point and a ramp cycloid section end point of the three-dimensional said ramp cycloid section;

(d) said ramp cycloid section being part of an overall race track that also comprises a coasting run, said coasting run being a straightforward continuation of said ramp cycloid section and said lane rolling surface of said coasting run being coincident with a horizontal reference plane, said reference plane having a flat and level surface;

(e) said ramp cycloid section further comprising a first, higher ramp section, and a second, lower ramp section, said first ramp section and said second ramp section being joined end-to-end to form said ramp cycloid section;

(f) in order to determine specific features of said ramp support structure and its interaction with said ramp cycloid section to cause it to have said curvature being that of said cycloid curve section, one should be familiar with certain mathematical characteristics of said cycloid curve that will allow one to produce the horizontal and vertical distances to which said ramp cycloid section must conform;

(g) said cycloid curve being a curve traced out by movement of a generating point fixed on the circumference of a circle, having a radius r, as said circle is being rotated by a rolling action, without slipping, horizontally in a right-handed sense as defined as the positive forward travel direction of said cars when viewing from their passenger side, said rolling action being along the underside of a straight horizontal x-axis, with the circumference of said circle being under and against said horizontal x-axis, and a rotation of said circle during said rolling action being measured by a rotation angle θ;

(h) said cycloid curve further being mathematically described in terms of a parameter pair which consists of said radius r and said rotation angle θ, said parameter pair defining a horizontal distance x of a point on said cycloid curve according to an equation (1) and $$x=r(\theta-\sin\theta) \quad (1)$$

$$y=r(1-\cos\theta) \quad (2)$$

further defining a vertical distance y of said point on said cycloid curve, measured positive downwards, according to an equation (2), and said equation (1) and said equation (2), together, being mathematically known as a pair of parametric equations of said cycloid curve;

(i) said equation (1), and said equation (2), thereby defining a cartesian coordinate pair x and y, denoted as (x,y), being used for locating any of a multitude of points on said cycloid curve, said cycloid curve multitude of points having a start point at an origin, said origin denoted as (0,0) with said cartesian coordinate pair x and y each being 0, and at said origin said rotation angle θ also being 0 before said generating point starts tracing said cycloid curve;

(j) said cycloid curve initially dropping sharply from said origin (0,0), proceeding in said right-handed sense, as said circle rolls, with reducing curvature, until said cycloid curve drops below said x-axis a maximum y distance $y_m$, there said cycloid curve becoming tangent, at a maximum x distance $x_m$, to a horizontal straight line through $y_m$, thereby defining said ramp cycloid section end point as $(x_m,y_m)$;

(k) said horizontal straight line through $y_m$ also lying in said horizontal reference plane, said plane being located at said distance $y_m$ below said origin (0,0), therefore said ramp cycloid section, having said predetermined end point at $(x_m,y_m)$, being suitable for smoothly joining to said coasting run;

(l) starting from directly below said ramp cycloid section start point, and measuring a ramp length d along said horizontal reference plane in the car travel direction, will locate said ramp cycloid section end point at $(x_m,y_m)$ and define said ramp length d;

(m) said ramp cycloid section start point, being measured vertically upwards from said horizontal reference plane, is at a ramp start height h;

(n) said predetermined start point on said cycloid curve that also marks said ramp cycloid section start point being hereby denoted by a cartesian coordinate pair $(x_o,y_o)$ that correspond to a rotation angle $\theta_o$, said ramp cycloid section start point having a x value $x_o$ and a y value $y_o$ being defined by an equation (3) and an equation (4), $$x_0=r(\theta_0 \mathbf{31} \sin\theta_0) \quad (3)$$

$$y_0=r(1-\cos\theta_0) \quad (4)$$

said equations obtained respectively from said equation (1) and said equation (2);

(o) said gravity-driven cars having a starting position with the center of each of said cars, as placed in their said lane, being positioned on a line being perpendicular to said ramp cycloid section and passing through said ramp cycloid section start point $(x_o,y_o)$, and further an extension being added above said ramp cycloid section, said extension extending opposite the racing travel direction and towards the rear of said cars, being behind said start point, said extension being for supporting the rear wheels of said cars, said extension being defined as a simple ½ car-length distance, said extension having a slope substantially the same as said slope at said ramp start point and said extension not being considered part of said ramp cycloid section as considered herein;

(p) said ramp cycloid section being more conveniently described by defining a horizontal ramp cycloid section coordinate X and a vertical ramp cycloid section coordinate Y with each being shifted a predetermined amount from said cartesian coordinates x and y, said horizontal ramp cycloid section coordinate X being 0 at said ramp cycloid section start point and increasing to said ramp length d at said ramp cycloid section end point, and further said vertical coordinate Y being measured positive from above said horizontal straight line through $y_m$, said horizontal line being located in said horizontal reference plane, said coordinate Y being said ramp start height h at said ramp cycloid section start point and decreasing to 0 at said ramp cycloid section end point, said coordinate X and said coordinate Y taken together called a ramp coordinate pair (X,Y), being mathematically described by an equation (5) and an equation (6), $$X=x-x_o \tag{5}$$

$$Y=y_m-y \tag{6}$$

with $x_o$ being defined as in said equation (3) and $y_m$, being said maximum distance of y;

(q) said equation (3) requiring $x_o$, and said equation (4) requiring $y_o$, being put in terms of given quantities, namely said ramp start height h and said ramp length d, thus x goes from zero to $x_o$, where said ramp starts, and continues on an amount being said ramp length d to $x_m$ at, which point said circle's said generating point has rolled $\pi=180°$ for a distance $x_m=\pi r$, thus an equation (7) below results, and said maximum y distance $y_m$, being just the diameter 2 r of said circle, and this amount, less said start height h, giving an equation (8) wherein y having said y value $y_o$ as measured downward starting from y =0 and ending at said ramp start height h , thus $$x_o=\pi r-d \tag{7}$$

$$y_o=2r-h \tag{8}$$

with $x_o$ and $y_o$ now being in terms of r, d and h;

(r) said equation (3) and said equation (4) being put in terms of h and d by substituting for $x_o$and $y_o$ using said equation (7) and said equation (8) respectively, giving an equation (9) and an equation (10)

$$\pi r-d=r(\theta_0-\sin\theta_0) \tag{9}$$

$$2r-h=r(1--\cos\theta_0) \tag{10}$$

and then solving said equation (9) and said equation (10) for r giving $$r=\frac{d}{\prod-\theta_0+\sin\theta_0} \tag{11}$$

$$r=\frac{h}{1+\cos\theta_0} \tag{12}$$

where an equation (11) and an equation (12) above being independent expressions for r;

(s) one needs to solve said equation (11) and said equation (12) for said circle radius r and for said $\theta_0$ value, being given a particular ramp start height h and a particular ramp length d from a preferred embodiment, it being customary in the art for a car center start height being substantially 4 ft, thus also allowing for a 2.5 cm=1- inch ramp thickness one can choose said lane surface of said ramp cycloid section as having said particular ramp start height h as being 1inch less at h=119.38 cm or 47.00 in, and also it being customary in the art for an uncurved ramp length being substantially 16 ft=487.68 cm, being projected on said horizontal plane, in effect creating a ramp shadow, said shadow being substantially 1 foot=30.5 cm less giving said particular ramp length d=15 ft=456.42 cm, thus with said particular ramp start height h and said particular ramp length d being chosen at these particular values by an art practitioner, one proceeds to solve said equation (11) and said equation (12), these being in parametric form thus requiring a graph-based solution being carried out for said parameter pair r and $\theta_0$ by plotting a pair of graph-based curves, one for each of said equation (11) and said equation (12), said graph-based curves having mutually perpendicular axes for each of said parameter pair r and $\theta_0$ and further noting said curves cross at a specific r value, r =238.40 cm, and a specific $\theta_0$value, $\theta_0$=119.95° or 2.0938 rad, said specific r value and said specific $\theta_0$ value being input to said equation (7) and said equation (8) giving an equation (13) and an equation (14) below, $$x_0=\pi r-d=292.53\text{ cm} \tag{13}$$

$$y_0=2r-h=357.42\text{ cm} \tag{14}$$

said equation (13) and said equation (14) then giving said ramp cycloid section start point having said cartesian coordinate pair;

(t) using said ramp coordinate pair X and Y for describing said ramp cycloid section start point, one has from said equation (5) and said equation (6) that X=0 and Y =h =119.38 cm;

(u) for an example of calculating said ramp coordinate pair X and Y at an arbitrary point on said ramp cycloid section, one chooses a Y value height, say at 80% of said particular ramp start height h, thus said Y=95.5 cm and one gets a specific y value y=2r−0.8h =381.30cm from said equation (6), then rearranging said equation (2), resulting in an equation (15), and putting said specific y value and said specific r value into said equation (15), thus getting a resulting θ value of θ=2.214 radians, said resulting θ value being input into said equation (1), reproduced here for convenience, giving x =336.88 cm, and from said equation (5) one gets a value X=44.34 cm, thus at a horizontal distance of 44.34 cm from said ramp start point, said Y value height being 95.5 cm, and said example being repeated to give said horizontal displacement distance X for any given height Y of said arbitrary point, allowing creation of a table of (X,Y) distances based on multiple determinations of said ramp coordinate pair (X,Y);

(v) whereby, after having selected values for said ramp start height h and said ramp length d, and having obtained values for said parameter pair r and θ, being available from said graph-based solution of said equation (11) and said equation (12), said art practitioner then being able to produce said horizontal coordinate X and said vertical coordinate Y for any of said arbitrary points on said ramp cycloid section between said ramp start point and said ramp end point, thus providing said table of (X,Y) distances with which said art practitioner can cause said ramp to conform to during construction and set-up of said ramp.

20. The ramp of claim 19, wherein said ramp support structure urges said ramp cycloid section to assume the shape of, and substantially conform to, said cycloid curve section by using one or a plurality of ramp support members, one of said support members, called a first ramp support member, being of proper predetermined length to force a first point on said lane rolling surface of said ramp first section to substantially coincide with said ramp start height h, and other of said support members called secondary ramp support members having a proper predetermined length for allowing subsequent points on said lane rolling surface to substantially coincide with said table of distances corresponding to said ramp coordinate pairs (X,Y).

21. The ramp of claim 20, wherein a horizontal rigid sheet of predetermined thickness forms a base beneath said ramp cycloid section, said sheet extending below both of said first ramp section and second ramp section and the top surface said rigid sheet being coincident with said horizontal reference plane.

22. The ramp of claim 21, wherein said first ramp support member, being in a vertical position, and having a connection to the underside of said first ramp section, the lower end of said first ramp support member also being connected to and braced to said rigid sheet.

23. The ramp of claim 22, wherein said connection of said first ramp support member to the underside of said first ramp section being a first hinged connection, with a pivot of said first hinged connection directly below said ramp cycloid section start point.

24. The ramp of claim 21, wherein a plurality of connecting brackets are affixed at predetermined bracket positions on the underside of said first ramp section.

25. The ramp of claim 24, wherein said secondary ramp support members are each connected at their bottom by a secondary hinge, to said rigid sheet, and each of said secondary support members having a protuberance at the end opposite to said secondary hinge.

26. The ramp of claim 25, wherein said secondary ramp support members being able to rotate around said secondary hinges so that said protuberances of said secondary ramp support members are each intersecting with and firmly connecting to one of said connecting brackets, said secondary ramp support members being of proper predetermined length and proper predetermined number to force said subsequent points on said lane rolling surface to substantially coincide with said ramp coordinate pairs (X,Y) as determined from said table of (X,Y) distances.

27. The ramp of claim 26, wherein said subsequent points on said lane rolling surface being those points with said vertical distance Y being sequentially less than said ramp start height h.

28. The ramp of claim 21, wherein said secondary ramp support members are positioned at predetermined points beneath said second ramp section, said secondary ramp support members having one end connected to the underside of said second ramp section and the other end connected to said rigid sheet , thereby causing points on said lane rolling surface of said second ramp section to substantially coincide with said table of (X,Y) distances for said second ramp section.

29. An improved race track ramp, for one or a plurality of gravity-driven cars, comprising (a) a ramp cycloid section and a ramp support structure, said ramp cycloid section further comprising one or a plurality of identically elevated and sloped contiguous lanes, upon which wheels of said cars roll on a lane rolling surface, and said ramp cycloid section capable of having a curvature being that of a cycloid curve section, said curvature established by said ramp cycloid section being urged to assume the shape of said cycloid curve section by interacting with said support structure;

(b) said cycloid curve section being a continuous section of a cycloid curve, said cycloid curve section having a predetermined start point and a predetermined end point, said cycloid curve section being the shortest possible trajectory traced out by said car wheels on the top surface of said lanes of said ramp cycloid section;

(c) thus specification of a curve parameter describing said cycloid curve section, being itself a two-dimensional curve, applies as well to any of said identical lanes of the entire three-dimensional said ramp cycloid section, whereupon said predetermined start point and said predetermined end point of said cycloid curve section apply as well to a ramp cycloid section start point and a ramp cycloid section end point of the three-dimensional said ramp cycloid section;

(d) said ramp cycloid section being part of an overall race track that also comprises a coasting run, said coasting run being a straightforward continuation of said ramp cycloid section and said lane rolling surface of said coasting run being coincident with a horizontal reference plane, said reference plane having a flat and level surface;

(e) said ramp cycloid section further comprising a first, higher ramp section, and a second, lower ramp section, said first ramp section and said second ramp section being joined end-to-end to form said ramp cycloid section;

(f) in order to determine specific features of said ramp support structure and its interaction with said ramp cycloid section to cause it to have said curvature being that of said cycloid curve section, one should be familiar with certain mathematical characteristics of said cycloid curve that will allow one to produce the horizontal and vertical distances to which said ramp cycloid section must conform;

(g) said cycloid curve being a curve traced out by movement of a generating point fixed on the circumference of a circle, having a radius r, as said circle is being rotated by a rolling action, without slipping, horizontally in a right-handed sense as defined as the positive forward travel direction of said cars when viewing from their passenger side, said rolling action being along the underside of a straight horizontal x-axis, with the circumference of said circle being under and against said horizontal x-axis, and a rotation of said circle during said rolling action being measured by a rotation angle θ;

(h) said cycloid curve further being mathematically described in terms of a parameter pair which consists of said radius r and said rotation angle θ, said parameter pair defining a horizontal distance x of a point on said cycloid curve according to an equation (1) and further defining a vertical distance y of said point on said cycloid curve, measured positive downwards, according to an equation (2), and said equation (1) and said equation (2), $$x=r(\theta-\sin\theta) \quad (1)$$

$$y=r(1-\cos\theta) \quad (2)$$

together, being mathematically known as a pair of parametric equations of said cycloid curve;

(i) said equation (1), and said equation (2), thereby defining a cartesian coordinate pair x and y, denoted as (x,y), being used for locating any of a multitude of points on said cycloid curve, said cycloid curve multitude of points having a start point at an origin, said origin denoted as (0,0) with said cartesian coordinate pair x and y each being 0, and at said origin said rotation angle θ also being 0 before said generating point starts tracing said cycloid curve;

(j) said cycloid curve initially dropping sharply from said origin (0,0), proceeding in said right-handed sense, as said circle rolls, with reducing curvature, until said cycloid curve drops below said x-axis a maximum y distance $y_m$, there said cycloid curve becoming tangent, at a maximum x distance $x_m$ to a horizontal straight line through $y_m$ thereby defining said ramp cycloid section end point as $(x_m,y_m)$;

(k) said horizontal straight line through $y_m$, also lying in said horizontal reference plane, said plane being located at said distance $y_m$, below said origin (0,0), therefore said ramp cycloid section, having said predetermined end point at $(x_m,y_m)$, being suitable for smoothly joining to said coasting run;

(l) starting from directly below said ramp cycloid section start point, and measuring a ramp length d along said horizontal reference plane in the car travel direction, will locate said ramp cycloid section end point at $(x_m,y_m)$ and define said ramp length d;

(m) said ramp cycloid section start point, being measured vertically upwards from said horizontal reference plane, is at a ramp start height h;

(n) said predetermined start point on said cycloid curve that also marks said ramp cycloid section start point being hereby denoted by a cartesian coordinate pair $(x_o,y_o)$ that correspond to a rotation angle $\theta_o$, said ramp cycloid section start point having a x value and a y value being defined by an equation (3) and an equation (4), $$x_0=r(\theta_0-\sin\theta_0 \tag{3}$$

$$y_0=r(1-\cos\theta_0) \tag{4}$$

said equations obtained respectively from said equation (1) and said equation (2);

(o) said gravity-driven cars having a starting position with the center of each of said cars, as placed in their said lane, being positioned on a line being perpendicular to said ramp cycloid section and passing through said ramp cycloid section start point, and further an extension being added above said ramp cycloid section, said extension extending opposite the racing travel direction and towards the rear of said cars, being behind said start point, said extension being for supporting the rear wheels of said cars, said extension being defined as a simple ½, car-length distance, said extension having a slope substantially the same as said slope at said ramp start point and said extension not being considered part of said ramp cycloid section as considered herein;

(p) said ramp cycloid section being more conveniently described by defining a horizontal ramp cycloid section coordinate X and a vertical ramp cycloid section coordinate Y with each being shifted a predetermined amount from said cartesian coordinates x and y, said horizontal ramp cycloid section coordinate X being 0 at said ramp cycloid section start point and increasing to said ramp length d at said ramp cycloid section end point, and further said vertical coordinate Y being measured positive from above said horizontal straight line through $y_m$ said horizontal line being located in said horizontal reference plane, said coordinate Y being said ramp start height h at said ramp cycloid section start point and decreasing to 0 at said ramp cycloid section end point, said coordinate X and said coordinate Y taken together called a ramp coordinate pair (X,Y), being mathematically described by an equation (5) and an equation (6), $$X=x-x_o \tag{5}$$

$$Y=y_m-y \tag{6}$$

with $x_o$ being defined as in said equation (3) and $y_m$ being said maximum distance of y;

(q) said equation (3) requiring $x_o$, and said equation (4) requiring $y_o$, being put in terms of given quantities, namely said ramp start height h and said ramp length d, thus x goes from zero to $x_o$, where said ramp starts, and continues on an amount being said ramp length d to $x_m$ at, which point said circle's said generating point has rolled $\pi=180°$ for a distance $x_m=\pi r$, thus an equation (7) below results, and said maximum y distance $y_m$ being just the diameter 2 r of said circle, and this amount, less said start height h, giving an equation (8) wherein y having said y value $y_o$ as measured downward starting from y=0 and ending at said ramp start height h , thus $$x_o=\pi r-d \tag{7}$$

$$y_o=2r-h \tag{8}$$

with $x_o$, and $y_o$ now being in terms of r, d and h;

(r) said equation (3) and said equation (4) being put in terms of h and d by substituting for $x_o$ and $y_o$ using said equation (7) and said equation (8) respectively, giving an equation (9) and an $$\pi r-d=r(\theta_0-\sin\theta_0) \tag{9}$$

$$2r-=r(1-\cos\theta_0) \tag{10}$$

equation (10), and then solving said equation (9) and said equation (10) for r giving $$r=\frac{d}{\Pi-\theta_0+\sin\theta_0} \tag{11}$$

$$r=\frac{h}{1+\cos\theta_0} \tag{12}$$

where an equation (11) and an equation (12) above being independent expressions for r;

(s) one needs to solve said equation (11) and said equation (12) for said circle radius r and for said $\theta_0$ value, being given a particular ramp start height h and a particular ramp length d from a preferred embodiment, it being customary in the art for a car center start height being substantially 4 ft, thus also allowing for a 2.5 cm=1- inch ramp thickness one can choose said lane surface of said ramp cycloid section as having said particular ramp start height h as being 1 inch less at h=119.38 cm or 47.00 in, and also it being customary in the art for an uncurved ramp length being substantially 16 ft=487.68 cm, being projected on said horizontal plane, in effect creating a ramp shadow, said shadow being substantially 1 foot=30.5 cm less giving said particular ramp length d =15 ft =456.42 cm, thus withsaid particular ramp start height h and said particular ramp length d being chosen at these particular values by an art practitioner, one proceeds to solve said equation (11) and said equation (12), these being in parametric form thus requiring a graph-based solution being carried out for said parameter pair r and $\theta_0$ by plotting a pair of graph-based curves, one for each of said equation (11) and said equation (12), said graph-based curves having mutually perpendicular axes for each of said parameter pair r and $\theta_0$ and further noting said curves cross at a specific r value, r =238.40 cm, and a specific $\theta_0$ value, $\theta_0$ =119.95° or 2.0938 rad, said specific r value and said specific $\theta_0$ value being input to said equation (7) and said equation (8) giving an equation (13) and an equation (14) below, $$x_0=\pi r-d=292.53\text{cm} \tag{13}$$

$$y_0=2r-h=357.42\text{ cm} \tag{14}$$

said equation (13) and said equation (14) then giving said ramp cycloid section start point having said cartesian coordinate pair ;

(t) using said ramp coordinate pair X and Y for describing said ramp cycloid section start point, one has from said equation (5) and said equation (6) that X =0 and Y =h =119.38 cm;

(u) for an example of calculating said ramp coordinate pair X and Y at an arbitrary point on said ramp cycloid section, one chooses a Y value height, say at 80% of said particular ramp start height h, thus said Y=95.5 cm and one gets a specific y value y =2r−0.8h =381.30cm from said equation (6), then rearranging said equation (2), resulting in an equation (15) below, and putting said specific y value and said specific r value into said equation (15), thus getting a resulting θ value of θ=2.214 radians, said resulting θ value being input into said $$\theta = \cos^{-1}\left(1-\frac{y}{r}\right) \tag{15}$$

$$x=r(\theta-\sin\theta) \tag{1}$$

equation (1), reproduced here for convenience, giving x=336.88 cm, and from said equation (5) one gets a value X=44.34 cm, thus at a horizontal distance of 44.34 cm from said ramp start point, said Y value height being 95.5 cm, and said example being repeated to give said horizontal displacement distance X of any given height Y of said arbitrary point, thereby creating a table of (X, Y) distances corresponding to said ramp coordinate pair (X,Y);

(v) whereby, after having selected values for said ramp start height h and said ramp length d, and having obtained values for said parameter pair r and θ, being available from said graph-based solution of said equation (11) and said equation (12), said art practitioner then being able to produce said horizontal coordinate X and said vertical coordinate Y for any of said arbitrary points on said ramp cycloid section between said ramp start point and said ramp end point, thus providing said table of (X, Y) distances with which said art practitioner can cause said ramp to conform to during construction and set-up of said ramp.

30. The ramp of claim 29 wherein said support structure for said ramp cycloid section comprises a plurality of support panels, said panels being rigid sheets of predetermined thickness being arranged perpendicularly to said horizontal plane, said plurality of support panels further comprising 4 side support panels, namely a first section right side support panel and a first section left side support panel, both supporting said first ramp section, and also comprising a second section right side support panel and a second section left side support panel, both supporting said second ramp section, said plurality of panels also comprising a plurality of cross-piece support panels that form ends at right angles between said first section right side support panel and said first section left side support panel and also form ends at right angles between said second section right side support panel and said second section left side support panel.

31. The ramp of claim 30 wherein said first section right side support panel and said second section right side support panel having a precut curve at their top, so that said side support panels, when joined smoothly together end-to-end, will display said precut curve that matches said cycloid curve section as defined by said table of (X,Y) distances, and further, said first section left side support panel and said second section left side support panel when joined smoothly together end-to-end, will also display said precut curve that matches said cycloid curve section.

32. The ramp of claim 31 wherein said cross-piece support panels being used for ends at right angles to said side support panels, said cross-piece support panels being connected between and perpendicular to said side panels to form two free-standing box structures, comprising a ramp first section box structure and a ramp second section box structure, said two box structures fitting the length and breadth of said ramp first section and said ramp second section respectively.

33. The ramp of claim 32 with said ramp first section being firmly connected to the top of said ramp first section box structure, and said ramp second section also being firmly connected to the top of said ramp second section box structure, thus urging said ramp first section and said ramp second section to assume the shape of said cycloid curve section as defined by said table of (X,Y) distances.

34. The ramp of claim 33 wherein said ramp first section box structure topped by said ramp first section and said ramp second section box structure topped by said ramp second section are smoothly joined end-to-end forming said ramp cycloid section and said ramp support structure.

* * * * *